US010124578B2

(12) United States Patent
Sakurai et al.

(10) Patent No.: US 10,124,578 B2
(45) Date of Patent: Nov. 13, 2018

(54) NOZZLE-CLOGGING DETERMINING DEVICE

(71) Applicant: MIMAKI ENGINEERING CO., LTD., Nagano (JP)

(72) Inventors: Kazumi Sakurai, Nagano (JP); Akihiko Mizusaki, Nagano (JP); Eiji Miyashita, Nagano (JP); Masaki Kodaira, Nagano (JP); Naoki Takizawa, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/310,437

(22) PCT Filed: May 15, 2015

(86) PCT No.: PCT/JP2015/064116
§ 371 (c)(1),
(2) Date: Nov. 10, 2016

(87) PCT Pub. No.: WO2015/174536
PCT Pub. Date: Nov. 19, 2015

(65) Prior Publication Data

US 2017/0087821 A1 Mar. 30, 2017

(30) Foreign Application Priority Data

May 16, 2014 (JP) ..... 2014-102904

(51) Int. Cl.
*B41J 2/045* (2006.01)
*B41J 2/165* (2006.01)
*B41J 2/01* (2006.01)

(52) U.S. Cl.
CPC ..... *B41J 2/0451* (2013.01); *B41J 2/01* (2013.01); *B41J 2/04586* (2013.01); *B41J 2/165* (2013.01); *B41J 2/16579* (2013.01)

(58) Field of Classification Search
CPC ..... B41J 2/0451; B41J 2/04586
See application file for complete search history.

(56) References Cited

U.S. PATENT DOCUMENTS

2002/0140760 A1* 10/2002 Bruch ..... B41J 2/0451 347/19
2002/0158938 A1* 10/2002 Doval ..... B41J 2/16579 347/22

(Continued)

FOREIGN PATENT DOCUMENTS

EP 1027987 8/2000
JP 2003225996 8/2003

(Continued)

OTHER PUBLICATIONS

"International Search Report (Form PCT/ISA/210) of PCT/JP2015/064116", dated Aug. 11, 2015, with English translation thereof, pp. 1-4.

(Continued)

*Primary Examiner* — Bradley Thies
(74) *Attorney, Agent, or Firm* — JCIPRNET

(57) ABSTRACT

A nozzle-clogging determining device is provided for detecting nozzle clogging without causing an increase in the cost. A nozzle-clogging determining device is configured to detect pass of droplets ejected from a plurality of nozzles of a head of an inkjet printer, and includes a droplet detector and a determination controller. The droplet detector includes a light emitter configured to emit detection light for detecting pass of droplets in a direction intersecting with a traveling direction of droplets, and a light receiver configured to receive the detection light. The determination con- (Continued)

troller consecutively ejects a plurality of droplets from each nozzle of the head at equal intervals, and has a threshold for performing determination on nozzle clogging on the basis of a light interception rate of the detection light which the light receiver receives when droplets are positioned inside a spot of the detection light which the light receiver receives.

8 Claims, 16 Drawing Sheets

(56) References Cited

U.S. PATENT DOCUMENTS

2002/0180824 A1* 12/2002 Endo ..... B41J 2/16579 347/19
2003/0090534 A1* 5/2003 Valero ..... B41J 2/16579 347/19
2007/0024658 A1* 2/2007 Diol ..... B41J 2/2142 347/19
2009/0015609 A1* 1/2009 Choo ..... B41J 2/125 347/9
2012/0223997 A1 9/2012 Abe
2013/0155136 A1 6/2013 Sakurada

FOREIGN PATENT DOCUMENTS

JP 3858680 12/2006
JP 2013180525 9/2013

OTHER PUBLICATIONS

"Search Report of European Counterpart Application", dated Dec. 1, 2017, p. 1-p. 8, in which the listed references were cited.
"Office Action of China Counterpart Application," with English translation thereof, dated Jun. 27, 2017, p. 1-p. 14.

* cited by examiner

NOZZLE-CLOGGING DETERMINING DEVICE

CROSS-REFERENCE TO RELATED APPLICATION

This application is a 371 of international application of PCT application serial no. PCT/JP2015/064116, filed on May 15, 2015, which claims the priority benefits of Japan application no. JP 2014-102904, filed on May 16, 2014. The entirety of each of the abovementioned patent applications is hereby incorporated by reference herein and made a part of this specification.

TECHNICAL FIELD

The present invention relates to a nozzle-clogging determining device.

BACKGROUND ART

In the related art, an inkjet printer has a nozzle-clogging determining device for detecting nozzle clogging of ink from individual nozzles provided in a head (for example, Patent Literature 1). The nozzle-clogging determining device disclosed in Patent Literature 1 has a light emitting device for emitting laser light intersecting with the traveling direction of ink droplets from the nozzles, and a light receiving device for receiving the laser light from the light emitting device, and detects nozzle clogging of ink from the individual nozzles by making ink droplets passing through the laser light emitted by the light emitting device.

CITATION LIST

Patent Literature

Patent Literature 1: JP-3858680

SUMMARY

Technical Problem

Recently, in order to form high-resolution images, in inkjet printers, ink droplets to be ejected have been set to have vary small volumes of 4 pl (picoliters) or less. For this reason, the nozzle-clogging determining device for detecting nozzle clogging of ink from the individual nozzles is required to condense the laser light by a lens in order to secure an S/N ratio (Signal to Noise ratio). In this case, even through a deviation in relative position between the head having the nozzles and the nozzle-clogging determining device is several μm, it is difficult to make ink droplets pass through the laser light, and the accuracy of detection on nozzle clogging of ink decreases. Also, as lenses for condensing laser beams, high-quality lenses have been required, and thus there has been a tendency for the cost to increase. Further, if the accuracy of positioning of the head and the nozzle-clogging determining device is set to high accuracy, there is a tendency for the cost to increase. Moreover, even if a nozzle consecutively ejects a plurality of ink droplets, depending on the state of the nozzle, there is a fear that the ink droplets may not block the laser light. For this reason, in order to suppress error detection, it has been required to eject a plurality of ink droplets, a plurality of times, and thus there has been a tendency for a time for detection to lengthen.

The present invention was made in view of the above-described circumstances, and an object of the present invention is to provide a nozzle-clogging determining device capable of detecting nozzle clogging without causing an increase in cost.

Solution to Problem

In order to solve the above-described problems and achieve the object, a nozzle-clogging determining device according to the present invention is a nozzle-clogging determining device configured to detect pass of a plurality of droplets ejected from nozzles of a head of an inkjet printer, thereby performing determination on clogging of the nozzles, including: a droplet detector which includes a light emitter configured to emit detection light for detecting pass of the droplets in a direction intersecting with a traveling direction of the droplets, and a light receiver configured to receive the detection light, and in which the light emitter, a passage of the droplets, and a light receiver are disposed along a light path of the detection light; and a determination controller configured to eject a plurality of droplets from the nozzles of the head, and perform determination on nozzle clogging on the basis of a light interception rate of the detection light which the light receiver receives when the droplets are positioned inside a spot of the detection light which the light receiver receives.

According to this invention, since determination on nozzle clogging is performed by positioning a plurality of ejected droplets inside a spot of the detection light which the light receiver receives, it is possible to cause a difference between the intensity of the detection light which the light receiver receives when droplets block the detection light and the intensity of the detection light which the light receiver receives when any droplets does not block the detection light, without providing a lens usable to condense the detection light and likely to cause an increase in cost. Therefore, this invention can improve the S/N ratio of the light receiver even if droplets are small. Also, since this invention does not need to condense the detection light, even if the relative positions of the head having the nozzles and the nozzle-clogging determining device to each other shift, it is possible to surely detect nozzle clogging of ink. Therefore, since the accuracy of the relative positions of the head and the nozzle-clogging determining device does not need to be high accuracy, the nozzle-clogging determining device can detect nozzle clogging, without causing an increase in the cost. Also, since the determination controller has the determination reference for performing determination on nozzle clogging when a plurality of consecutive droplets ejected from each nozzle of the head is positioned inside the spot, the present invention can perform determination on nozzle clogging without repeating ejection of a plurality of consecutive droplets.

Also, in the above-described nozzle-clogging determining device, the determination controller may determine that the nozzles are clear, in a case where the light interception rate of the detection light which the light receiver receives is equal to or greater than a predetermined light interception rate, and determines that the nozzles are clogged, in a case where the light interception rate of the detection light is less than the predetermined light interception rate. Also, in the above-described nozzle-clogging determining device, the light receiver may be installed such that a length in a traveling direction of each spot of the detection light which the light emitter receives is longer than a length in a direction perpendicular to the traveling direction.

In this invention, since the length of each spot in the traveling direction of the detection light is longer than that in the interesting direction, it is possible to position a plurality of droplets inside a spot of the detection light, and it is possible to cause a difference between the intensity of the detection light which the light receiver receives when droplets block the detection light and the intensity of the detection light which the light receiver receives when any droplets does not block the detection light.

Also, in the above-described nozzle-clogging determining device, the determination controller may perform the followings: sequentially performing ejection of a plurality of consecutive droplets at equal intervals from the individual nozzles of the head; before and/or after sequentially performing consecutive ejection of the droplets from the individual nozzles, consecutively ejecting droplets from all of the nozzles of the head; and performing determination on nozzle clogging at intervals of a predetermined short time, on the basis of detection results of the droplet detector obtained by sequentially performing ejection of the droplets from the individual nozzles and ejecting droplets from all of the nozzles, and consecutively recording the nozzle clogging determination results, and then dividing the determination results obtained by sequentially performing consecutive ejection of the droplets from the individual nozzles and included in the consecutively recorded determination results, for the individual nozzles, at equal intervals of time, on the basis of a nozzle clogging determination result obtained by ejecting droplets from all nozzles, and determining whether the state of ejections of the individual nozzles are normal or not.

This invention sequentially performs ejection of a plurality of consecutive droplets at equal intervals from the individual nozzles, and consecutively ejects droplets from all nozzles before and/or after sequentially performing ejection from the individual nozzles, and performs determination on nozzle clogging at intervals of a short time, on the basis of detection results of the droplet detector, and consecutively records the determination results. Therefore, the nozzle-clogging determining device can obtain results in which determination results obtained by ejecting ink droplets from all nozzles and determination results obtained by sequentially performing ejection of consecutive droplets at equal intervals from the individual nozzles are arranged in chronological order. Since the nozzle-clogging determining device arranges determination results in chronological order, it is possible to quickly acquire those determination results, and it is possible to suppress determination times from lengthening. Also, since the nozzle-clogging determining device uses a determination result obtained by ejecting ink droplets from all nozzles as a reference, it is possible to easily distinguish between the determination results of the nozzles, and it is possible to surely grasp nozzle clogging when ink droplets are consecutively ejected at equal intervals from the individual nozzles.

Also, the nozzle-clogging determining device divides the determination results obtained by sequentially performing ejection of droplets from the individual nozzles, for the individual nozzles, at equal intervals of time with reference to the determination result obtained by ejecting ink droplets from every nozzle. Therefore, in the nozzle-clogging determining device, determination results of each period obtained by performing division at equal intervals of the period include nozzle clogging determination results obtained by consecutively ejecting ink droplets at equal intervals from the individual nozzles. Therefore, the nozzle-clogging determining device can surely grasp nozzle clogging from the individual nozzles.

Also, in the above-described nozzle-clogging determining device, if dividing the determination results obtained by sequentially performing consecutive ejection of the droplets from the individual nozzles are divided for the individual nozzles, at equal intervals of time, the determination controller may generate a histogram representing the number of occurrences of short time having determination results representing that nozzles are clear, in the divided determination results, and correct the histogram such that short time corresponding to the largest number of occurrences of determination results representing that nozzles are clear are positioned at the center.

This invention generates a histogram, and corrects the division of the determination results obtained by sequentially performing ejection of consecutive ink droplets at equal intervals from the individual nozzles, such that short time corresponding to the largest number of occurrences of determination results representing that nozzles are clear are positioned at the center of the histogram. Therefore, in the nozzle-clogging determining device, the determination results divided at equal intervals of time surely include nozzle clogging determination results obtained by ejecting ink from the individual nozzles, and thus it is possible to suppress a determination result obtained by ejecting ink droplets from a certain nozzle from being included in a plurality of divided determination results. Therefore, according to this invention, it is possible to suppress erroneous determination on whether the ejection states of the nozzles are normal or not.

Also, in the above-described nozzle-clogging determining device, when determining whether the ejection states of the individual nozzles are normal or not, the determination controller may determine that the ejection states are normal, if the number of short time having determination results representing that nozzles are clear in the determination results divided for the individual nozzles is equal to or greater than a predetermined number, and determine that the ejection states are abnormal, if the number of short time having determination results representing that nozzles are clear in the determination results divided for the individual nozzles is less than the predetermined number.

This invention determines whether the ejection states of the nozzles are normal or not, on the basis of the number of short time having determination results representing that nozzles are clear, in the determination results divided at equal intervals of the period. Therefore, since the nozzle-clogging determining device deter mines whether the ejection states of the individual nozzles are normal or not, on the basis of the determination results of a plurality of short time, it is possible to suppress erroneous determination on whether the ejection states of the nozzles are normal or not.

Advantageous Effects of Invention

The nozzle-clogging determining device according to the present invention achieves an effect that it is possible to detect nozzle clogging without causing an increase in the cost.

Further, even if the nozzles are used for a long time and they degrade with age, whereby the condition of the head becomes slightly bad to such an extent that the flying speed of ink decreases or completely spherical droplets are not ejected and a plurality of droplets is continuously ejected, the nozzle-clogging determining device according to the present invention generates a histogram, and corrects the division of the determination results obtained by sequentially performing ejection of ink droplets from the individual nozzles, such that short time corresponding to the largest number of occurrences of determination results representing that nozzles are clear are positioned at the center of the histogram. Therefore, in the determination results divided for the individual nozzles, short time having determination results representing that the nozzles are clear are positioned at the center. Therefore, the nozzle-clogging determining device achieves an effect that it is possible to accurately determine whether the ejection states of the nozzles are normal or not. Further, since short time having determination results representing that the nozzles are clear are positioned at the center in the determination results divided for the individual nozzles, even in a case of changing an ink type due to variation in the flying speed according to ink properties, the nozzle-clogging determining device achieves an effect that it is possible to accurately determine whether the ejection states of the nozzles are normal or not.

BRIEF DESCRIPTION OF DRAWINGS

FIG. 6 is a view illustrating a spot of detection light which a light receiver of the nozzle-clogging determining device according to the embodiment receives, and so on.

FIG. 19 is a view illustrating another example of a spot of the detection light which the light receiver of the nozzle-clogging determining device according to the embodiment receives, and so on.

FIG. 20 is a view illustrating a further example of a spot of the detection light which the light receiver of the nozzle-clogging determining device according to the embodiment receives, and so on.

DESCRIPTION OF EMBODIMENTS

Hereinafter, embodiments of the present invention will be described in detail on the basis of drawings. However, this invention is not limited by the embodiments. Also, components of the following embodiments include components which those skilled in the art can easily replace them with, or components substantially identical to them.

Embodiments

Figure 1:
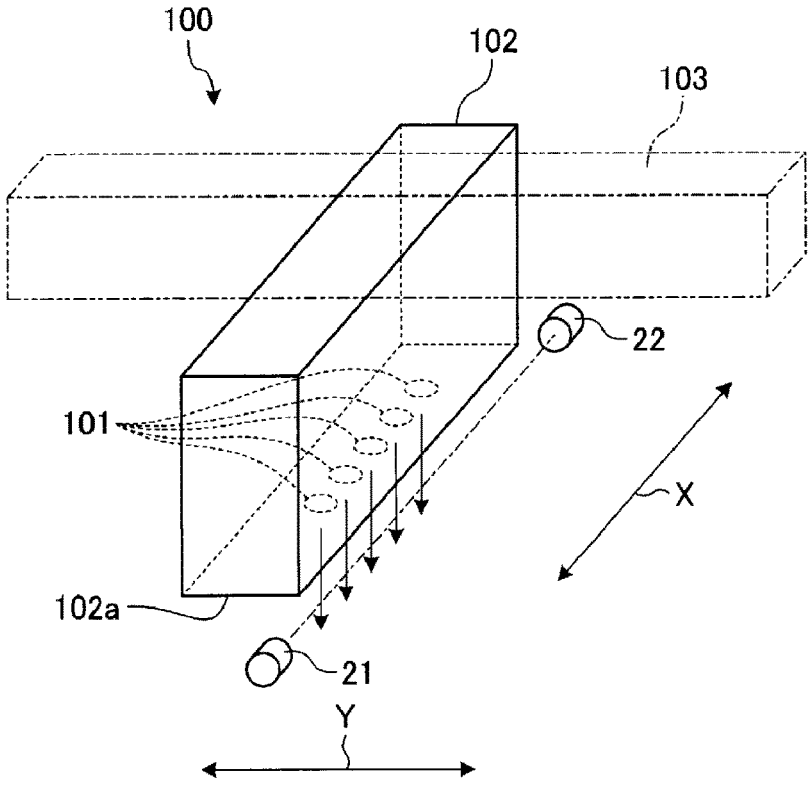
FIG. 1 is a perspective view illustrating a main part of an inkjet printer having a nozzle-clogging determining device according to an embodiment.
Figure 2:
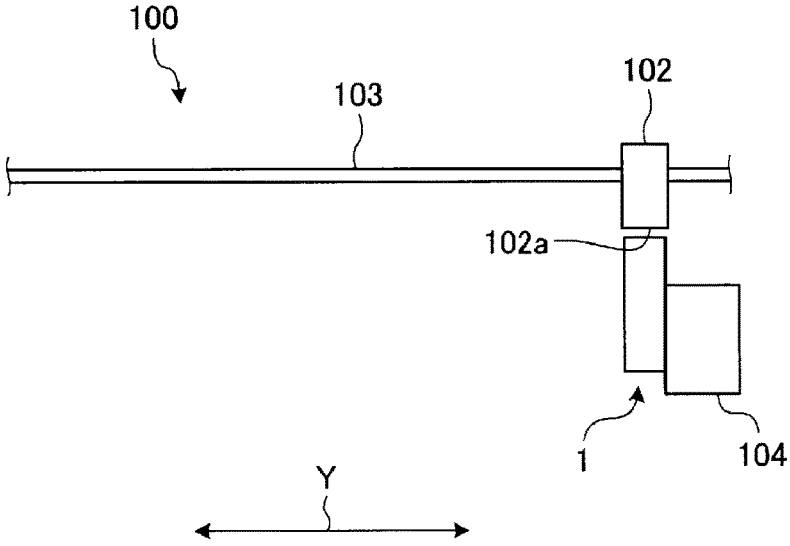
FIG. 2 is a front view illustrating a main part of the inkjet printer having the nozzle-clogging determining device according to the embodiment.

Hereinafter, a nozzle-clogging determining device according to an embodiment of the present invention will be described in detail on the basis of the drawings. FIG. 1 is a perspective view illustrating a main part of an inkjet printer having the nozzle-clogging determining device according to the embodiment. FIG. 2 is a front view illustrating a main part of the inkjet printer having the nozzle-clogging determining device according to the embodiment.

A nozzle-clogging determining device 1 according to the present embodiment is applied to an inkjet printer 100 shown in FIG. 1. The inkjet printer 100 is configured to perform printing on a print medium by reciprocating a head 102 having a plurality of nozzles 101 (shown in FIG. 1 and so on) for ejecting droplets D (shown in FIG. 6 and so on) of ink supplied from an ink container (not shown in the drawings) in a main scan direction Y along a Y bar 103, and ejecting ink droplets D from the nozzles 101 onto the print medium. The head 102 is supported on the Y bar 103 installed in parallel to the main scan direction Y, so as to be movable. The nozzles 101 are disposed in a lower surface 102*a* of the head 102 facing the print medium, on a straight line in a sub scan direction X perpendicular to the main scan direction Y. The nozzles 101 are configured to include various ink flow passages, regulators and pumps provided on the ink flow passages, and so on. The individual nozzles 101 of the head 102 eject droplets D of for example, 4 pl (picoliters) by an inkjet system.

The nozzle-clogging determining device 1 is installed below the Y bar 103 and outside a movement range of the head 102 in the main scan direction Y during printing, as shown in FIG. 2, and is configured to perform determination on clogging of each nozzle 101 by detecting pass of ink droplets D ejected from the plurality of nozzles 101 of the head 102. In the present embodiment, the nozzle-clogging determining device 1 is adjacent to a cleaning device 104 for cleaning the nozzles 101 of the head 102.

Figure 3:
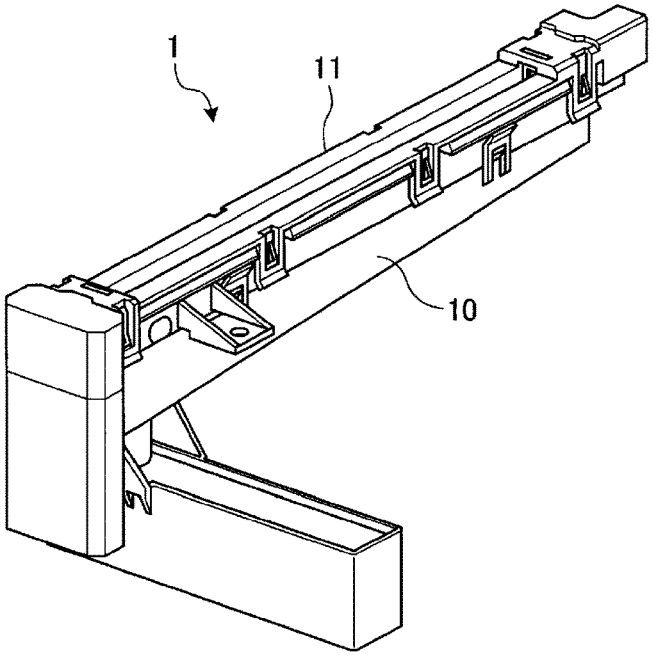
FIG. 3 is a perspective view illustrating the nozzle-clogging determining device according to the embodiment.
Figure 4:
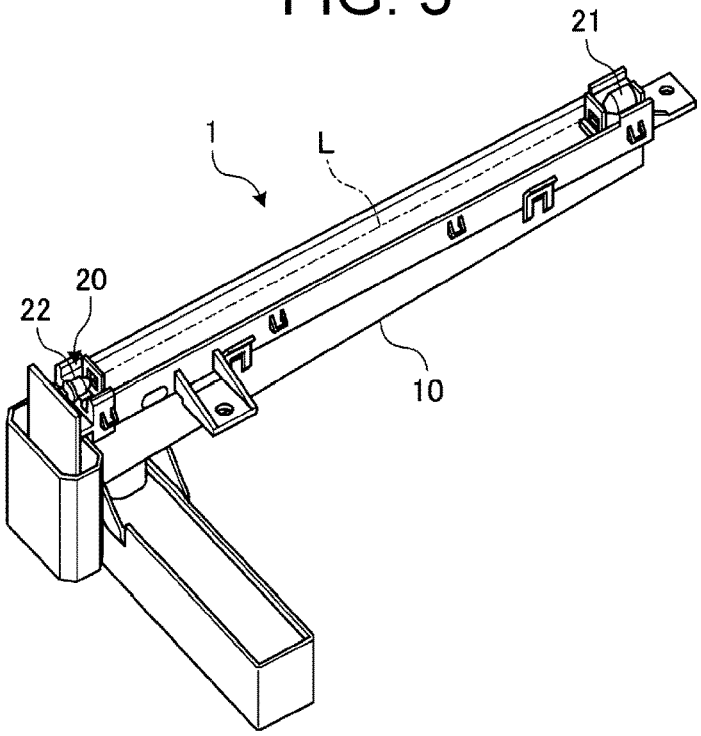
FIG. 4 is another perspective view illustrating the nozzle-clogging determining device according to the embodiment.
Figure 5:
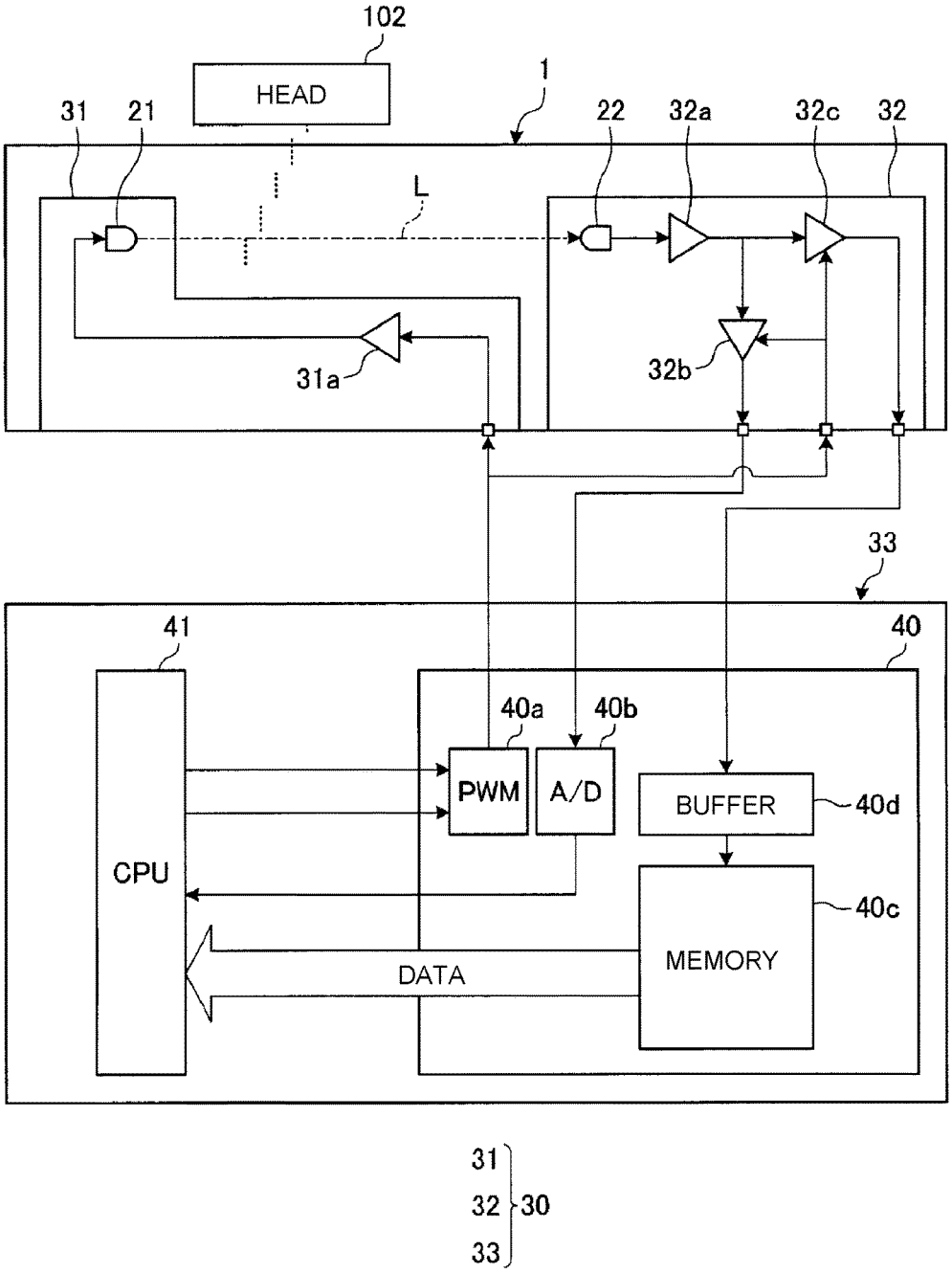
FIG. 5 is a block diagram illustrating the configuration of the inkjet printer having the nozzle-clogging determining device according to the embodiment.
Figure 6:
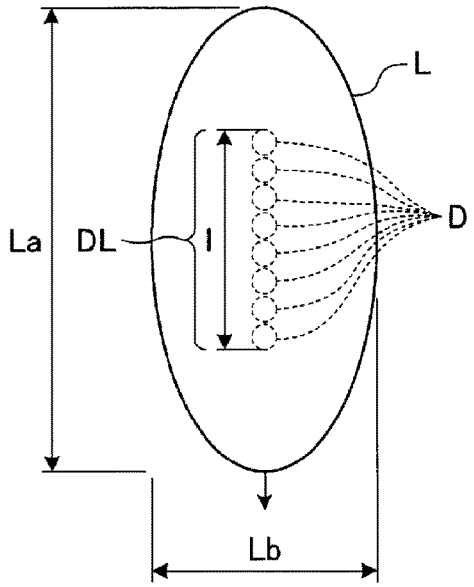
Figure 7:
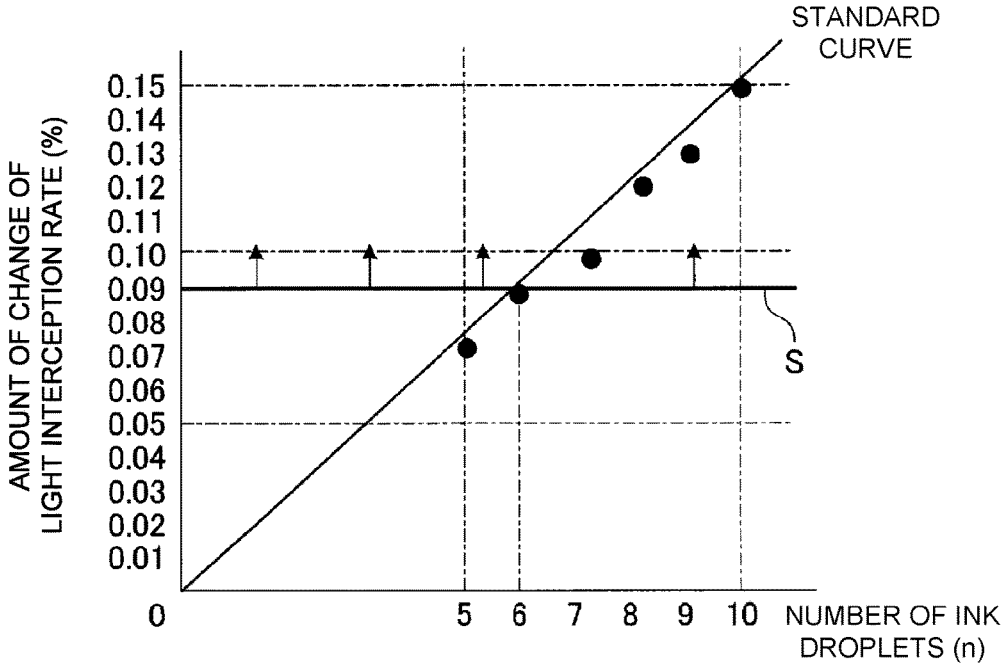
FIG. 7 is a view for explaining a threshold which is used in nozzle clogging determination of the nozzle-clogging determining device according to the embodiment.
Figure 8A:
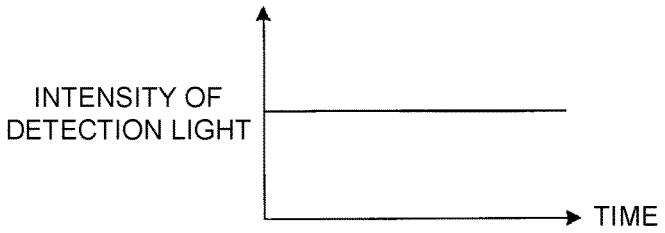
FIG. 8A is a view illustrating a detection light signal which the light receiver detects when the nozzle-clogging determining device according to the embodiment does not eject ink droplets.
Figure 8B:
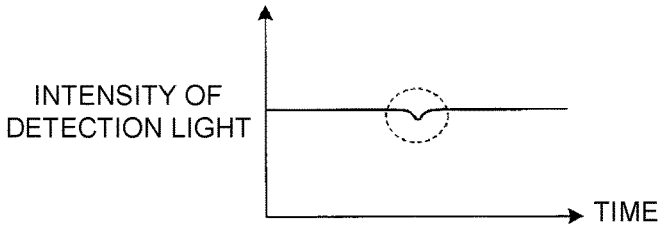
FIG. 8B is a view illustrating a detection light signal which the light receiver detects when the nozzle-clogging determining device according to the embodiment ejects ink droplets.
Figure 8C:
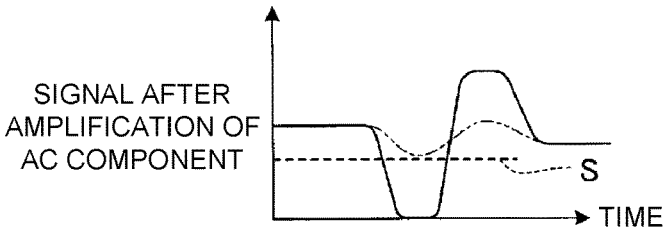
FIG. 8C is a view in which only an AC component of the detection light signal shown in FIG. 8B has been amplified.
Figure 8D:
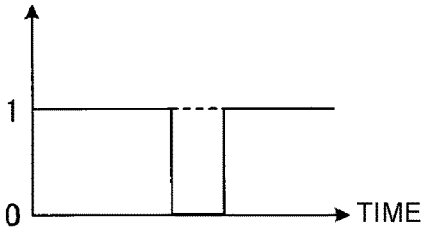
FIG. 8D is a view in which a pulse has been generated in the detection light signal of FIG. 8C in which only the AC component was amplified.
Figure 9:
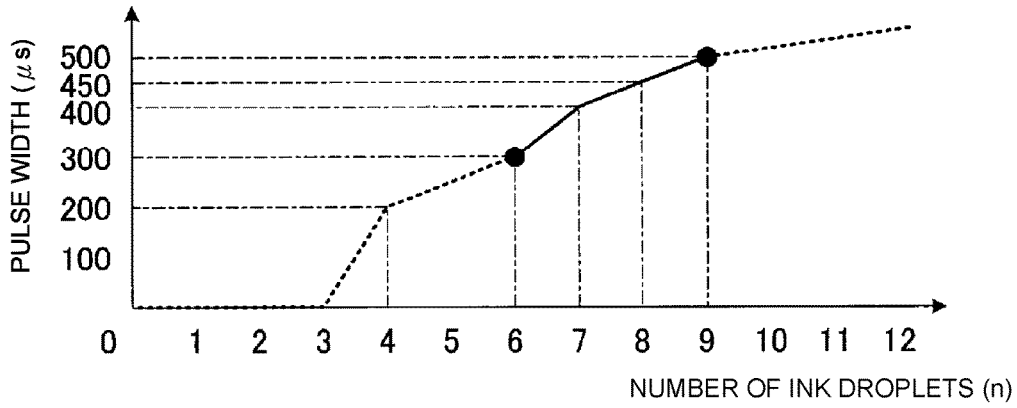
FIG. 9 is a view illustrating a plurality of ink droplets which is consecutively ejected by the nozzle-clogging determining device according to the embodiment.

Now, the nozzle-clogging determining device 1 will be described in detail on the basis of drawings. FIG. 3 is a perspective view illustrating the nozzle-clogging determining device according to the embodiment. FIG. 4 is another perspective view illustrating the nozzle-clogging determining device according to the embodiment. FIG. 5 is a block diagram illustrating the configuration of the inkjet printer having the nozzle-clogging determining device according to the embodiment. FIG. 6 is a view illustrating a spot of detection light which is received by a light receiver of the nozzle-clogging determining device according to the embodiment. FIG. 7 is a view for explaining a threshold which is used in nozzle clogging determination of the nozzle-clogging determining device according to the embodiment. FIG. 8A is a view illustrating a detection light signal which the light receiver detects when the nozzle-clogging determining device according to the embodiment does not eject ink droplets. FIG. 8B is a view illustrating a view illustrating a detection light signal which the light receiver detects when the nozzle-clogging determining device according to the embodiment ejects ink droplets. FIG. 8C is a view in which only an AC component of the detection light signal shown in FIG. 8B has been amplified. FIG. 8D is a view in which a pulse has been generated in the detection light signal of FIG. 8C in which only the AC component was amplified. FIG. 9 is a view illustrating the number of ink droplets which are consecutively ejected by the nozzle-clogging determining device according to the embodiment.

As shown in FIG. 3 and FIG. 4, the nozzle-clogging determining device 1 includes an ink absorption case 10, a droplet detector 20 (shown in FIG. 4), and a determination controller 30 (shown in FIG. 5). The ink absorption case 10 is configured to receive and absorb ink droplets D ejected from the individual nozzles 101 of the head 102. The ink absorption case 10 is installed below the Y bar 103, and is formed in a box shape with an open top. The ink absorption case 10 extends linearly in parallel to the sub scan direction X, and the ink absorption case 10 has a frame-shaped cover member 11 (shown in FIG. 3) attached to its upper end portion, and cover the droplet detector 20 and the like, together with the cover member 11.

As shown in FIG. 4, the droplet detector 20 includes a light emitter 21 and a light receiver 22. The light emitter 21 is configured to emit detection light L for detecting pass of droplets D, in the sub scan direction X intersecting with the traveling direction of the droplets D ejected from the individual nozzles 101 of the head 102. The light emitter 21 is composed of, for example, an LED (light emitting diode) and the like. The light emitter 21 is attached to one end portion of the upper end portion of the ink absorption case 10 in the longitudinal direction of the ink absorption case 10. The light emitter 21 emits the detection light L toward the other end portion of the ink absorption case 10.

The light receiver 22 is installed on the opposite side of a passage of droplets D to the light emitter 21, and is configured to receive the detection light L emitted by the light emitter 21. In other words, the light emitter 21, the passage of droplets D, and the light receiver 22 are disposed along the light path of the detection light L. The light receiver 22 is composed of, for example, a PD (photodiode) and the like. The light receiver 22 is attached to the other end portion of the upper end portion of the ink absorption case 10 in the longitudinal direction of the ink absorption case 10. If the detection light L emitted by the light emitter 21 is blocked by droplets D ejected from the nozzles 101, whereby the intensity of the detection light L which is received by the light receiver 22 becomes weaker than that in a case where the detection light is not blocked, the droplet detector 20 detects pass of droplets D ejected from the nozzles 101.

Also, the droplet detector 20 does not have any optical component such as a condenser lens between the light emitter 21 and the light receiver 22. A spot (a cross section shape perpendicular to the axis of light) of the detection light L which is emitted by the light emitter 21 of the droplet detector 20 and is received by the light receiver 22 is formed in an elliptical shape having a long diameter parallel to the traveling direction of droplets D ejected from the nozzles 101, as shown in FIG. 6. The light receiver 22 is disposed such that a long diameter La (the length of the traveling direction) of a spot of the detection light L which is received by the light receiver 22 is longer than a short diameter Lb (the length in a direction intersecting with the traveling direction).

Also, in the present embodiment, in order for the droplet detector 20 to detect nozzle clogging of ink droplets D from the individual nozzles 101 of the head 102, the determination controller 30 consecutively ejects a plurality of, that is, eight droplets D at equal intervals of a period from each nozzle 101 of the head 102, thereby forming droplet groups DL (shown in FIG. 6 and so on) only once. A length l (shown in FIG. 6) in the traveling direction of each droplet group DL which is a set of the plurality of, that is, eight droplets D is shorter than the long diameter La of a spot of the detection light L. Like this, in the present invention, the length l of the droplet group DL which is a set of a plurality of that is, eight droplets D is refereed to as the length of the plurality of droplets D. In other words, in the present invention, during detection on nozzle clogging, the determination controller 30 consecutively ejects a plurality of droplets D having the length l in the traveling direction shorter than the long diameter La of the detection light L, from each nozzle 101 of the head 102, thereby forming the droplet groups DL only once.

The determination controller 30 controls individual units of the inkjet printer 100 including the nozzle-clogging determining device 1. The determination controller 30 performs determination on nozzle clogging on the basis of a light interception rate of the detection light L which the light receiver 22 receives when a plurality of droplets D consecutively ejected at equal intervals of the period is positioned in the spot of the detection light L which the light receiver 22 receives. The determination controller 30 determines that a nozzle 101 is clear, in a case where the light interception rate (shown in a vertical axis of FIG. 7) of the detection light L received by the light receiver 22 is equal to or greater than a threshold S (corresponding to a determination reference and shown in FIG. 7) which is a predetermined light interception rate, and determines that the nozzle 101 is clogged, in a case where the light interception rate is less than the threshold S. Also, the number of droplets D at which the light interception rate of the detection light L is equal to or greater than the threshold S (shown in FIG. 7) may be such a number that the light interception rate can exceed the threshold S when a droplet group DL is formed once by ejecting droplets D from a normal and clear nozzle 101, and does not necessarily need to be the total number of a plurality of droplets D which constitutes a droplet group DL. Like this, the determination controller 30 has the threshold S for determining nozzle clogging on the basis of the light interception rate of the detection light L which the light receiver 22 receives when droplets D are positioned inside a spot.

Also, in the present embodiment, as shown in FIG. 7, the threshold S is set a value at which the light interception rate of the detection light L which is received by the light receiver 22 becomes 0.09%. In other words, in the present embodiment, if a light interception rate is equal to or greater than 0.09%, it is determined that a nozzle 101 is clear; whereas if a light interception rate is less than 0.09%, it is determined that a nozzle 101 is clogged. Also, a light interception rate of 0% means a value when the detection light L emitted by the light emitter 21 is received by the light receiver 22 without being blocked at all, and a light interception rate of 100% means a value when all of the detection light L emitted by the light emitter 21 is blocked and the light receiver 22 cannot receive the detection light at all. Also, a horizontal axis of FIG. 7 represents the number of droplets D during ejection of droplets D of large dots at an ejection frequency of 14.5 KHz.

As shown in FIG. 5, the determination controller 30 includes an LED board 31, a control board 32, and a controller 33. The LED board 31 is attached to one end portion of the ink absorption case 10, and has the light emitter 21 mounted thereon. Also, the LED board 31 has a constant current circuit 31*a* mounted thereon and configured to receive a signal representing a set light amount from a PWM circuit 40*a* to be described below and output the received signal to the light emitter 21.

The control board 32 is attached to the other end portion of the ink absorption case 10, and has the light receiver 22 mounted thereon. Also, the control board 32 has a light reception amplifier 32*a* mounted thereon and configured to amplify a signal representing the intensity of the detection light L received by the light receiver 22, a circuit 32*b* mounted thereon and configured to detect a light reception bias and a position from a DC component of the signal amplified by the light reception amplifier 32*a*, and a circuit 32*c* mounted thereon and configured to amplify only AC components of the signal amplified by the light reception amplifier 32*a* and perform pulse generation on the basis of the threshold S input from a CPU 41 (to be described below) of the determination controller 30.

For example, as shown in FIG. 8A, when a horizontal axis represents time, in a state where any ink droplet D is not being ejected from a nozzle 101, a signal obtained by amplifying the intensity of the detection light L received by the light receiver 22 by the light reception amplifier 32*a* becomes constant. However, if ink droplets D are ejected from the nozzle 101, as shown in FIG. 8B, when the ink droplets D are positioned in a spot of the detection light L, a signal obtained by amplifying the intensity of the detection light L received by the light receiver 22 by the light reception amplifier 32*a* becomes slightly weak (as shown by a dotted line in FIG. 8B). The circuit 32*c* amplifies only an AC component (a portion surrounded by the dotted line in FIG. 8B) of the signal representing the intensity of the detection light L, as shown in FIG. 8C. Then, if the amplified AC component exceeds the threshold S, the circuit 32*c* generates a pulse as shown in FIG. 8D.

A state shown by a solid line in FIG. 8C represents that the amplified AC component, that is, the light interception rate of the detection light L becomes equal to or greater than the threshold S. As shown in FIG. 8D, the generated pulse shows that the light interception rate of the detection light L received by the light receiver 22 is equal to or greater than the threshold S, that is, that it is determined that the nozzle 101 is clear. In other words, in the present embodiment, "0" of a vertical axis of FIG. 8D represents that it is determined that the nozzle 101 is clear, and "1" of the vertical axis of FIG. 8D represents that it is determined that the nozzle 101 is clogged. Also, a state shown by an alternate long and two short dashes line in FIG. 8C represents that the amplified AC component, that is, the light interception rate of the detection light L becomes less than the threshold S, that is, that it is determined that the nozzle 101 is clogged. In this case, as shown by a dotted line in FIG. 8D, any pulse is not generated. In this way, the circuit 32*c* generates a determination result (shown in FIG. 8D) representing nozzle clogging. Also, it is preferable that the width of the pulse at this moment be within a range from 300 μsec to 500 μsec. The reason is that, if the pulse width is less than 300 μsec, it becomes difficult to distinguish between the pulse and noise, and if the pulse width exceeds 500 μsec, it influences a range of detection on the next nozzle 101 and the subsequent nozzles, thereby causing the droplet detector 20 to be incapable of accurate detection. Also, from the relation of FIG. 9 with the number of droplets D during ejection of droplets D of large dots at the ejection frequency of 14.5 KHz, it is preferable that the number of droplets D which are consecutively ejected from each nozzle 101 be equal to or greater than six and equal to or less than nine, and is set to eight in the present embodiment.

The controller 33 controls the individual units of the inkjet printer 100. As shown in FIG. 5, the controller 33 includes an integrated circuit unit 40, the CPU 41, and so on. The CPU 41 outputs a signal representing the set light amount of the light emitter 21, and a signal representing the threshold S, to the integrated circuit unit 40. Also, the CPU 41 receives a signal representing the light reception bias of the detection light L received by the light receiver 22 and the position of the received detection light L, and determination results of the circuit 32*c*.

The integrated circuit unit 40 includes the PWM circuit 40*a* to which the signal representing the set light amount and the signal representing the threshold S are input from the CPU 41, an A/D converter 40*b*, a memory 40*c*, and so on. The PWM circuit 40*a* outputs the signal representing the set light amount to the constant current circuit 31*a* of the LED board 31. The PWM circuit 40*a* outputs the signal representing the threshold S to the circuits 32*b* and 32*c*. The A/D converter 40*b* converts the signal input from the circuit 32*b* and representing the light reception bias and the position of the detection light L into a digital signal, and outputs the digital signal to the CPU 41. The memory 40*c* receives the nozzle clogging determination results from the circuit 32*c* through a buffer 40*d*, and temporarily keeps the determination results, and then outputs the determination results to the CPU 41.

Figure 10:
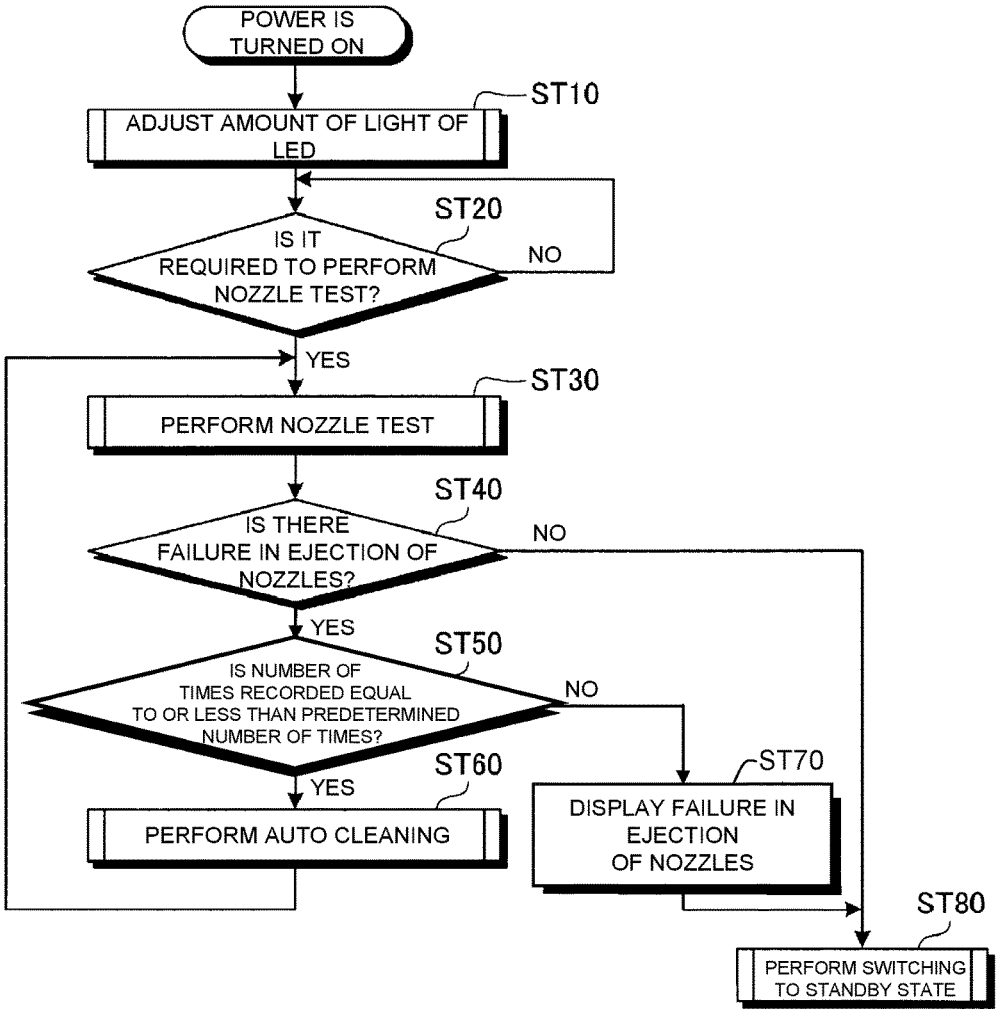
FIG. 10 is an example of a flow chart for determining whether the ejection states of individual nozzles of the inkjet printer having the nozzle-clogging determining device according to the embodiment are normal or not.
Figure 11A:
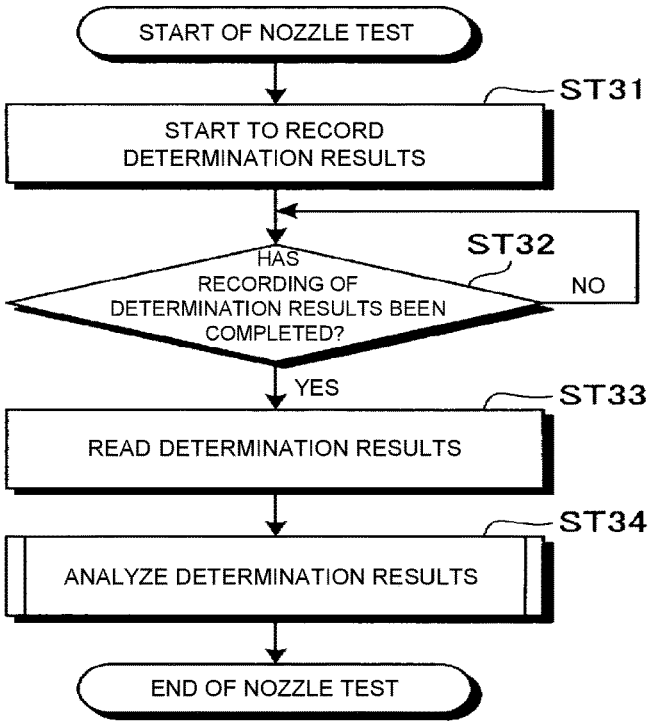
FIG. 11A is an example of a flow chart of STEP ST30 shown in FIG. 10.
Figure 11B:
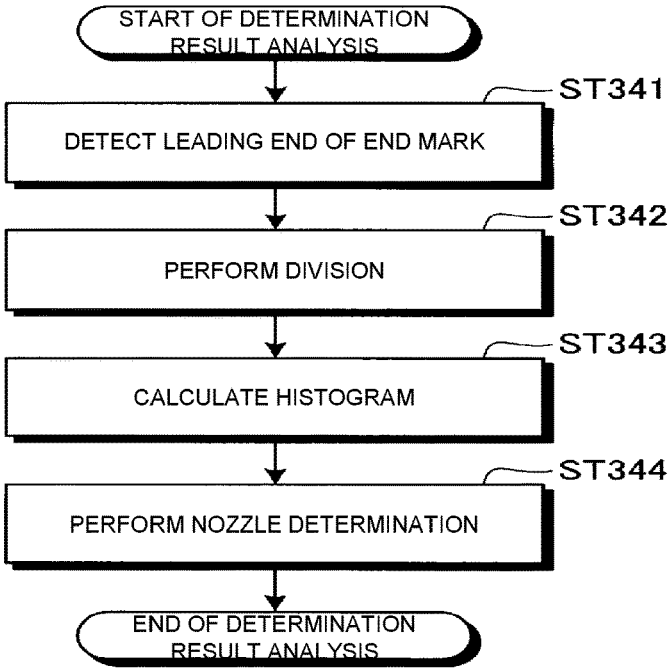
FIG. 11B is an example of a flow chart of STEP ST34 shown in FIG. 11A.
Figure 12A:
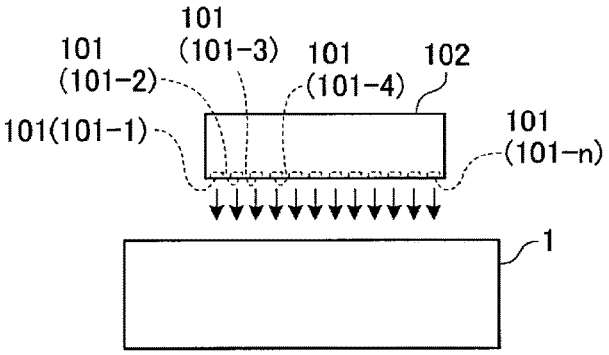
FIG. 12A is a view illustrating the outline of start mark ejection during determination on whether the ejection states of the individual nozzles of the inkjet printer having the nozzle-clogging determining device according to embodiment are normal or not.
Figure 12B:
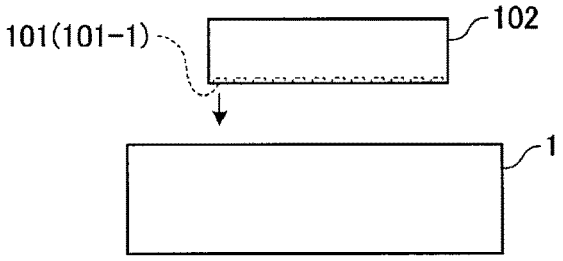
FIG. 12B is a view illustrating the outline of first nozzle ejection during determination on whether the ejection states of the individual nozzles of the inkjet printer having the nozzle-clogging determining device according to the embodiment are normal or not.
Figure 12C:
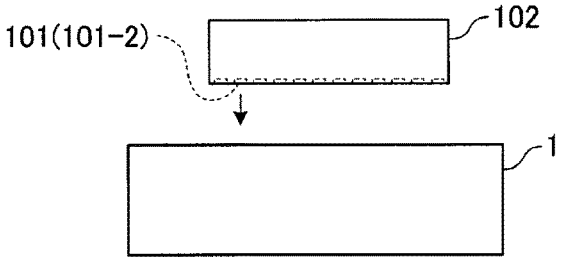
FIG. 12C is a view illustrating the outline of second nozzle ejection during determination on whether the ejection states of the individual nozzles of the inkjet printer having the nozzle-clogging determining device according to the embodiment are normal or not.
Figure 12D:
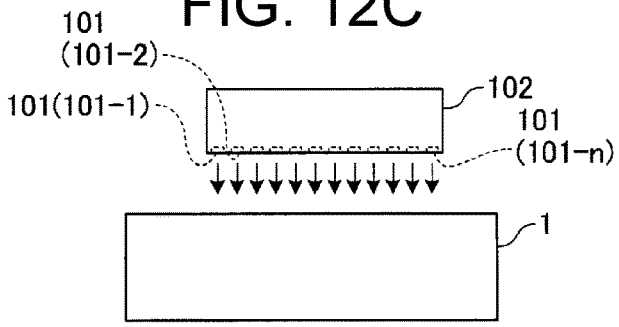
FIG. 12D is a view illustrating the outline of end mark ejection during determination on whether the ejection states of the individual nozzles of the inkjet printer having the nozzle-clogging determining device according to the embodiment are normal or not.

Now, with reference to flow charts of FIG. 10 and FIG. 11, and FIG. 12, examples of detection of the above-described nozzle-clogging determining device 1 on pass of ink droplets D ejected from each nozzle 101, that is, a method of performing determination on nozzle clogging of ink droplets D from each nozzle 101, and a method of determining whether the ejection states of the individual nozzles nozzle 101 are normal or not will be described. FIG. 10 is an example of a flow chart for determining whether the ejection states of the individual nozzles of the inkjet printer having the nozzle-clogging determining device according to the embodiment are normal or not. FIG. 11A is an example of a flow chart of STEP ST30 shown in FIG. 10. FIG. 11B is an example of a flow chart of STEP ST34 shown in FIG. 11A. FIG. 12A is a view illustrating the outline of start mark ejection during determination on whether the ejection states of the individual nozzles of the inkjet printer having the nozzle-clogging determining device according to embodiment are normal or not. FIG. 12B is a view illustrating the outline of first nozzle ejection during determination on whether the ejection state of each nozzle of the inkjet printer having the nozzle-clogging determining device according to the embodiment is normal or not. FIG. 12C is a view illustrating the outline of second nozzle ejection during determination on whether the ejection states of the individual nozzles of the inkjet printer having the nozzle-clogging determining device according to the embodiment are normal or not. FIG. 12D is a view illustrating the outline of end mark ejection during determination on whether the ejection states of the individual nozzles of the inkjet printer having the nozzle-clogging determining device according to the embodiment are normal or not. Also, determination on nozzle clogging of ink droplets D from each nozzle 101 and determination on whether the ejection states of the individual nozzle 101 are normal or not which are performed as a nozzle test are performed by the determination controller 30.

First, if a power source of the inkjet printer 100 is turned on, the determination controller 30 adjusts the light amount of the detection light L from the light emitter 21, for example, by emitting the detection light L from the light emitter 21 and making the light receiver 22 receive the detection light, without ejecting ink from the nozzles 101 of the nozzle-clogging determining device 1 (STEP ST10). Also, at this time, the positions of droplets D which are ejected from the nozzles 101 may be detected, for example, by moving the head 102 until the head is positioned above the nozzle-clogging determining device 1 and ejecting ink droplets D from all nozzles 101 at the same time.

Subsequently, the determination controller 30 determines whether to perform a nozzle test (STEP ST20). If determining not to perform a nozzle test (No in STEP ST20), the determination controller 30 repeats the STEP ST20; whereas if determining to perform a nozzle test (Yes in STEP ST20), the determination controller performs a nozzle test (STEP ST30). Also, for example, immediately after the inkjet printer 100 is powered on, if the inkjet printer 100 starts printing or a command for performing a nozzle test is received from an operation panel (not shown in the drawings), the deter ruination controller 30 performs a nozzle test. A nozzle test method will be described below in detail.

The determination controller 30 determines whether the plurality of nozzles 101 includes any nozzle 101 abnormal in the ejection state of ink droplets D, that is, whether there is a failure in ejection of the nozzles (STEP ST40). If determining that the plurality of nozzles 101 does not include any nozzle 101 abnormal in the ejection state of ink droplets D, that is, there is no failure in ejection of the nozzles (No in STEP ST40), the determination controller 30 switches the inkjet printer 100 to a standby state (STEP ST80).

If determining that the plurality of nozzles 101 includes any nozzles 101 abnormal in the ejection state of the ink droplets D, that is, there is a failure in ejection of the nozzles (Yes in STEP ST40), the determination controller 30 increases the number of times a failure in ejection of the nozzles has been determined, by 1, and records the number of times, and determines whether the number of times recorded is equal to or less than a predetermined number of times (STEP ST50). If determining that the number of times recorded is equal to or less than the predetermined number of times (Yes in STEP ST50), the determination controller 30 controls the cleaning device 104 such that the cleaning device cleans the individual nozzles 101 of the head 102 (STEP ST60), and returns to STEP ST30. If determining that the number of times recorded is greater than the predetermined number of times (No in STEP ST50), the determination controller 30 displays information, such as information representing that there is a failure in ejection of the nozzles, on a display screen of the operation panel or the like (STEP ST70), and switches the inkjet printer 100 to the standby state (STEP ST80). If the inkjet printer 100 is switched to the standby state, the determination controller 30 resets the number of times a failure in ejection of the nozzles has been determined in STEP ST40, to zero.

Figure 13:
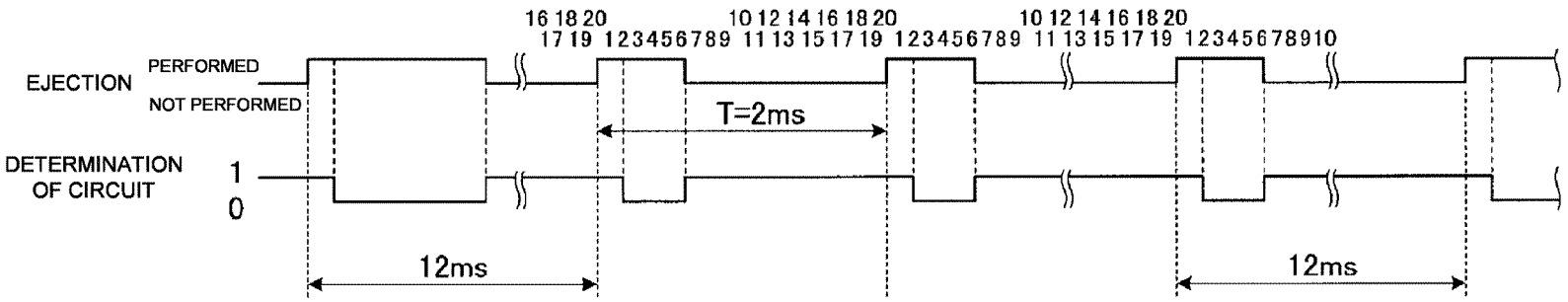
FIG. 13 is an example of a time chart illustrating ejection timings of the nozzles during a test on the nozzles of the inkjet printer having the nozzle-clogging determining device according to the embodiment, and determination timings of the nozzle-clogging determining device.
Figure 14:
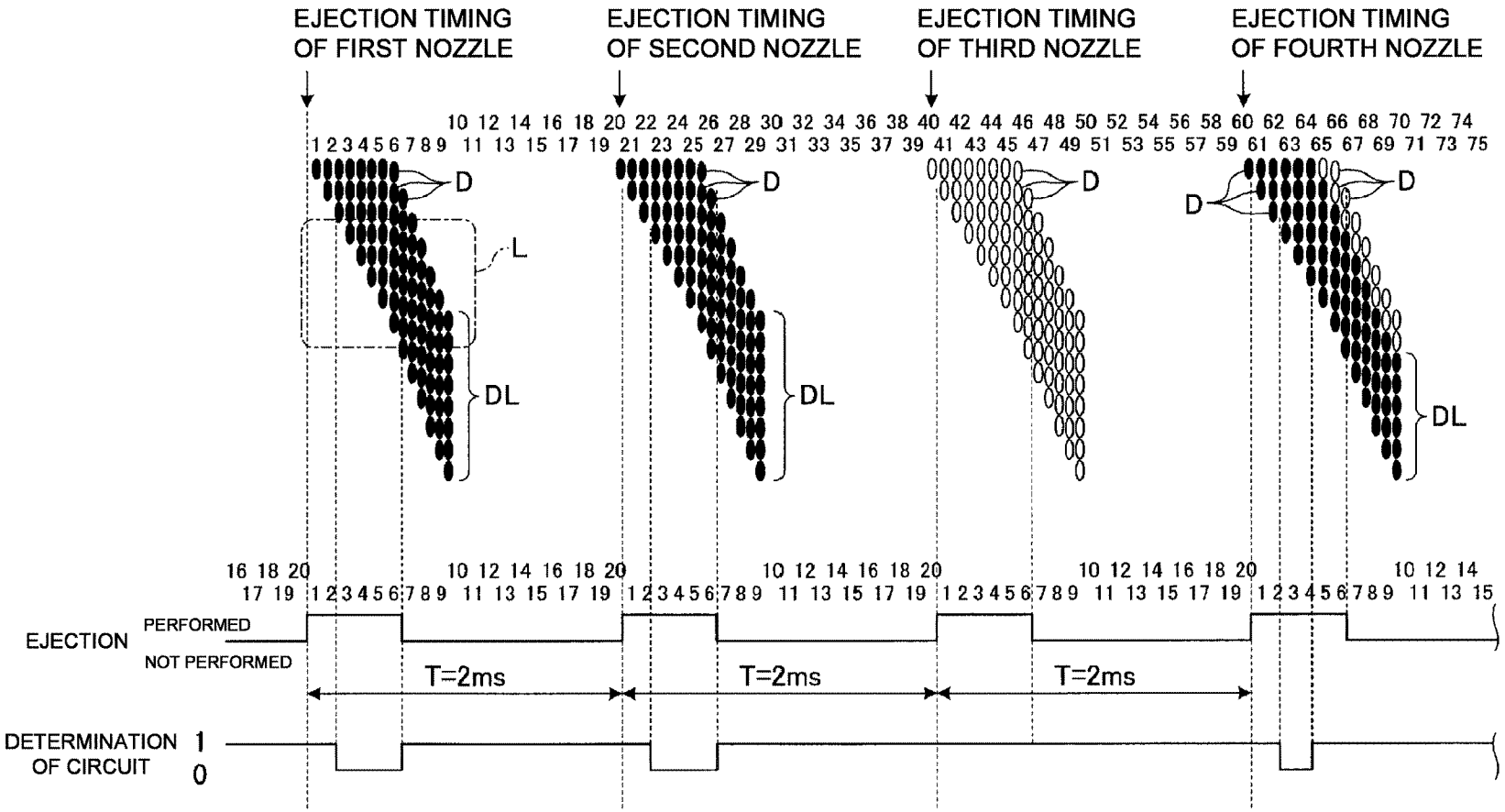
FIG. 14 is another example of the time chart illustrating ejection timings of the nozzles during a test on the nozzles of the inkjet printer having the nozzle-clogging determining device according to the embodiment, and determination timings of the nozzle-clogging determining device.
Figure 15:
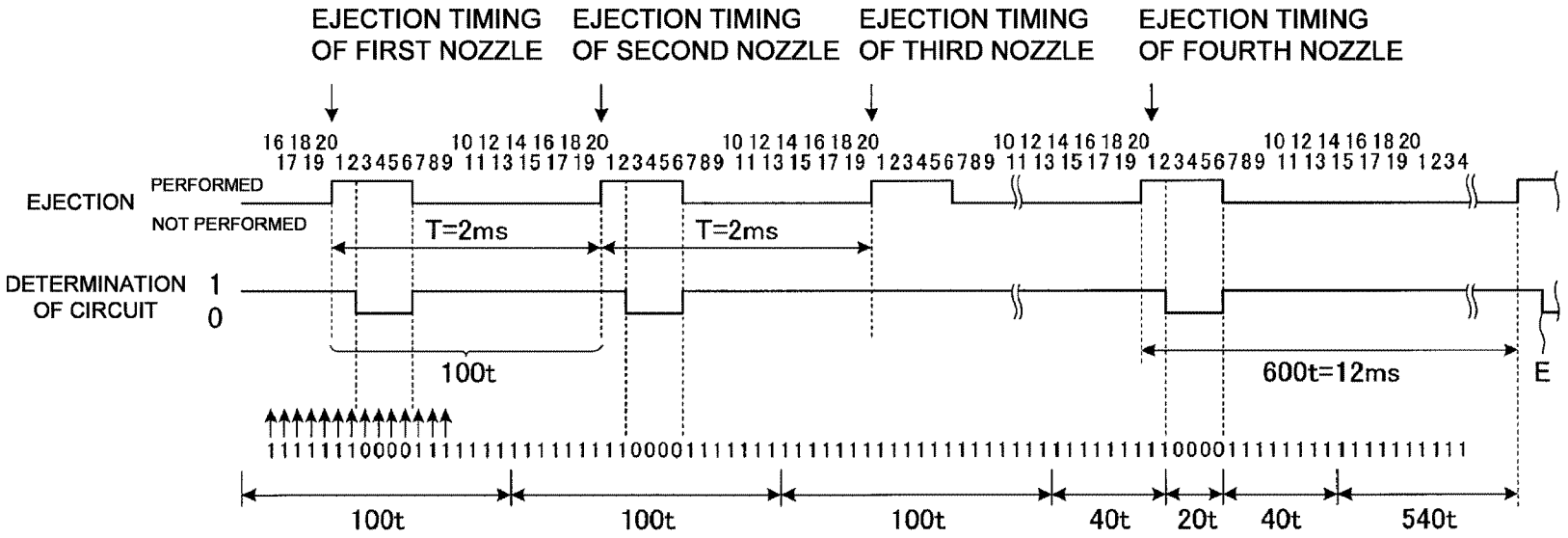
FIG. 15 is time chart illustrating an example of determination results recorded on the time chart shown in FIG. 14.

Now, examples of operations during the nozzle test (STEP ST30) will be described with reference to FIG. 11A, FIG. 12A, FIG. 12B, FIG. 12C, FIG. 12D, FIG. 13, FIG. 14, and FIG. 15. FIG. 13 is an example of a time chart illustrating ejection timings of the nozzles during a test on the nozzles of the inkjet printer having the nozzle-clogging determining device according to the embodiment, and determination timings of the nozzle-clogging determining device. FIG. 14 is another example of the time chart illustrating ejection timings of the nozzles during a test on the nozzles of the inkjet printer having the nozzle-clogging determining device according to the embodiment, and determination timings of the nozzle-clogging determining device. FIG. 15 is a time chart illustrating an example of determination results recorded on the time chart shown in FIG. 14.

The determination controller 30 controls the individual units of the inkjet printer 100 and the nozzle-clogging determining device 1, such that they starts the nozzle test and starts to record determination results of the circuit 32*c* (STEP ST31). Specifically, the determination controller 30 positions the head 102' above the nozzle-clogging determining device 1 such that ink droplets D which are ejected from the nozzles 101 pass through spots of the detection light L to be received by the light receiver 22. Subsequently, the determination controller 30 consecutively ejects droplets D from all nozzles 101 for a predetermined period, as shown in FIG. 12A. After ejection of ink droplets D from all nozzles 101 finishes, the determination controller 30 sequentially performs ejection of a plurality of, that is, eight consecutive ink droplets D having equal intervals of time from the individual nozzles 101 of the head 102 at intervals of at intervals of a predetermined period T (shown in FIG. 13).

In other words, the determination controller 30 consecutively ejects eight droplets D from a first nozzle 101-1 of the plurality of nozzles 101 positioned at one end of the sub scan direction X, at equal intervals of time, as shown in FIG. 12B, and if a predetermined period T elapses from the start of ejection of droplets D from the first nozzle 101-1, the determination controller consecutively ejects eight droplets D from a second nozzle 101-2 positioned closer to the other end of the sub scan direction X than the first nozzle 101-1 is, at equal intervals of time, as shown in FIG. 12C. The determination controller 30 sequentially performs ejection of eight consecutive droplets D having equal intervals of time from each nozzle 101, up to an N-th nozzle 101-*n*. After sequentially performing ejection of eight consecutive droplets D having equal intervals of time from each nozzle 101, up to the N-th nozzle, the determination controller 30 consecutively ejects droplets D from all nozzles 101 for a predetermined period.

In this way, the determination controller 30 sequentially performs ejection of eight consecutive droplets D having equal intervals of time from each nozzle 101 of the head 102, at intervals of the predetermined period T, and consecutively ejects droplets D from all nozzles 101 of the head 102 before and after sequentially performing ejection of droplets D from each nozzle 101. However, in the present invention, the determination controller 30 may consecutively eject droplets D from all nozzles 101 of the head 102 before and/or after sequentially performing ejection of droplets D from each nozzle 101.

Then, as shown in FIG. 13, when ejection of consecutive droplets D having equal intervals of time from each nozzle 101 is sequentially performed, and when droplets D are ejected from all nozzles 101, the droplet detector 20 detects the droplets D passing through the spots of the detection light L, and the circuit 32*c* performs determination on nozzle clogging of droplets D. Also, the upper part of FIG. 13 shows timings of ejection from the nozzles 101 of the head 102, and the lower part of FIG. 13 shows determination timings of the circuit 32*c* on nozzle clogging of droplets D in a case where droplets are normally ejected from the nozzles 101 at the timings shown in the upper part of FIG. 13.

In the present embodiment, the period between start of first ejection of droplets D from all nozzles 101 and start of ejection from the first nozzle 101-1 is 12 msec, and the predetermined period T from the start of ejection from the first nozzle 101-1 to start of ejection from the second nozzle 101-2 is 2 msec. In other words, the time interval between starts of ejection from the nozzles 101 is 2 msec which is the predetermined period T. Further, in the present embodiment, a time from start of ejection of the N-th nozzle to start of final ejection from all nozzles 101 is 12 msec.

In the present embodiment, when ejection of eight consecutive droplets D from each nozzle 101 is performed, the droplets D are ejected at equal intervals of time of a frequency of 14.5 KHz, and the ejection time of each droplet D from each nozzle 101 is 552 μsec. In a case where ink droplets D are normally ejected from all nozzles 101, as shown in the lower part of FIG. 13, after start of ejection from each nozzle 101, the circuit 32*c* determines that the corresponding nozzle is clear, and as compared to a time for which eight droplets D are consecutively ejected from each nozzle 101, a time required for the circuit 32*c* to determine that the corresponding nozzle is clear becomes slightly shorter.

Further, on the basis of the detection results of the droplet detector 20 when ejection of consecutive droplets D from each nozzle 101 having equal intervals of time is sequentially performed and when droplets D are ejected from all nozzles 101, the determination controller 30 performs determination on nozzle clogging at intervals of a predetermined short time t (shown in FIG. 15), and consecutively records the determination results. Specifically, as shown in FIG. 14, in a period which is defined as a period from start of first ejection of droplets D from all nozzles 101 to end of final ejection of droplets D from all nozzles 101 and includes a period when ejection of consecutive droplets D from each nozzle 101 is sequentially performed, light reception results of the light receiver 22 of the droplet detector 20 are determined by the circuit 32*c*, and the determination controller 30 consecutively records determination results of the circuit 32*c* in the memory 40*c* at intervals of 20 μsec which is the predetermined short time t.

In the period from start of first ejection of droplets D from all nozzles 101 to end of final ejection of droplets D from all nozzles 101, the determination controller 30 records determination results of the circuit 32*c*, that is, "0"s representing cases where nozzles are clear and "1"s representing cases where nozzles are clogged, at intervals of 20 μsec which is the predetermined short time t. The determination controller 30 temporarily stores the determination results of the circuit 32*c* obtained at intervals of 20 μsec which is the predetermined short time t, in the buffer 40*d*, and then consecutively records the determination results in the memory 40*c*. Also, the upper part of FIG. 14 shows timings of ejection of the individual nozzles 101 of the head 102, eight droplets D ejected from each nozzle, the spots of the detection light L received by the recovery container 2, and so on, and the middle part of FIG. 14 shows timings of ejection of the nozzles 101 of the head 102, and the lower part of FIG. 14 shows examples of determination results of the circuit 32*c*. Also, in the upper part of FIG. 14, droplets D which are normally ejected are shown by black circles, and droplets D which are not ejected are shown by white circles.

Therefore, FIG. 14 shows an example in which, from each of the first nozzle 101-1 and the second nozzle 101-2, eight consecutive droplets D have been normally ejected, and from a third nozzle 101-3, it has not been possible to eject any droplet D, and from a fourth nozzle 101-4, first six droplets D has been consecutively ejected but it has not been possible to eject last two droplets D. Therefore, the determination results of the circuit 32*c* shown in the lower part of FIG. 14 show that droplets D have been nomially ejected from the first nozzle 101-1 and the second nozzle 101-2, and it has not been determined from the third nozzle 101-3 that the nozzle has been clear, and a time when it has been determined from the fourth nozzle 101-4 that the nozzle has been clear is shorter than those of the first nozzle 101-1 and the second nozzle 101-2.

Also, in a period which is defined as a period from start of first ejection of droplets D from all nozzles 101 to end of final ejection of droplets D from all nozzles 101 and includes a period when ejection of consecutive droplets D from each nozzle 101 is sequentially perform red, the determination controller 30 determines whether consecutive recording of the determination results of the circuit 32*c* at intervals of the predetermined short time t has been completed (STEP ST32). If determining that recording of the determination results has not been completed (No in STEP ST32), the determination controller 30 repeats STEP ST32. If it is determined that recording of the determination results has been completed (Yes in STEP ST32), the CPU 41 reads the consecutive determination results recorded in the memory 40*c* (STEP ST33), and the determination controller 30 analyzes the read determination results (STEP ST34).

At this time, the read determination results consist of "0" and "1" which are determination results of the circuit 32*c* obtained at intervals of the predetermined short time t such as 20 μsec in the period from start of first ejection of droplets D from all nozzles 101 to end of final ejection of droplets D from all nozzles 101. Also, the upper part of FIG. 15 shows timings of ejection of individual nozzles 101 of the head 102, and the middle part of FIG. 15 shows examples of the determination results of the circuit 32*c*, and the lower part of FIG. 15 shows examples of consecutive determination results read by the CPU 41.

Figure 16:
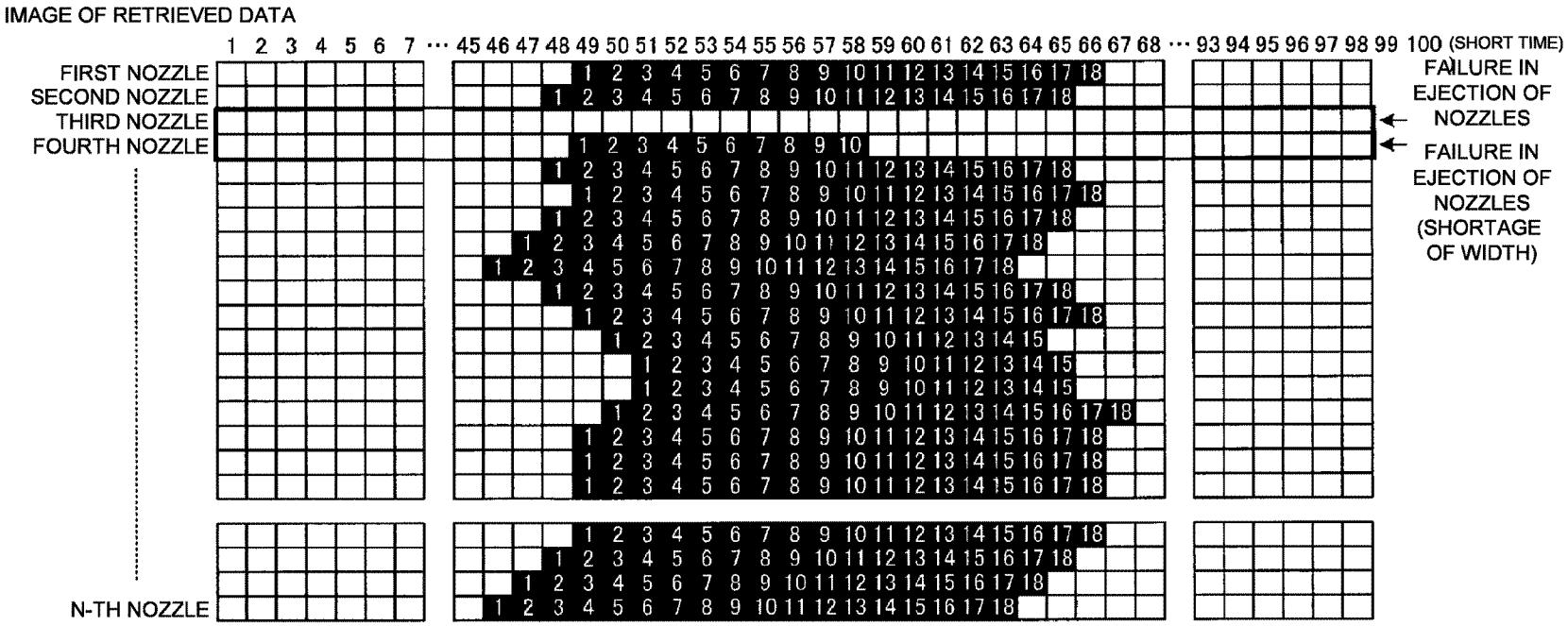
FIG. 16 is a view illustrating an example in which determination results included in consecutive determination results read by a CPU and obtained by sequentially performing ejection of droplets from each nozzle have been divided at equal intervals of time for the individual nozzles.
Figure 17A:
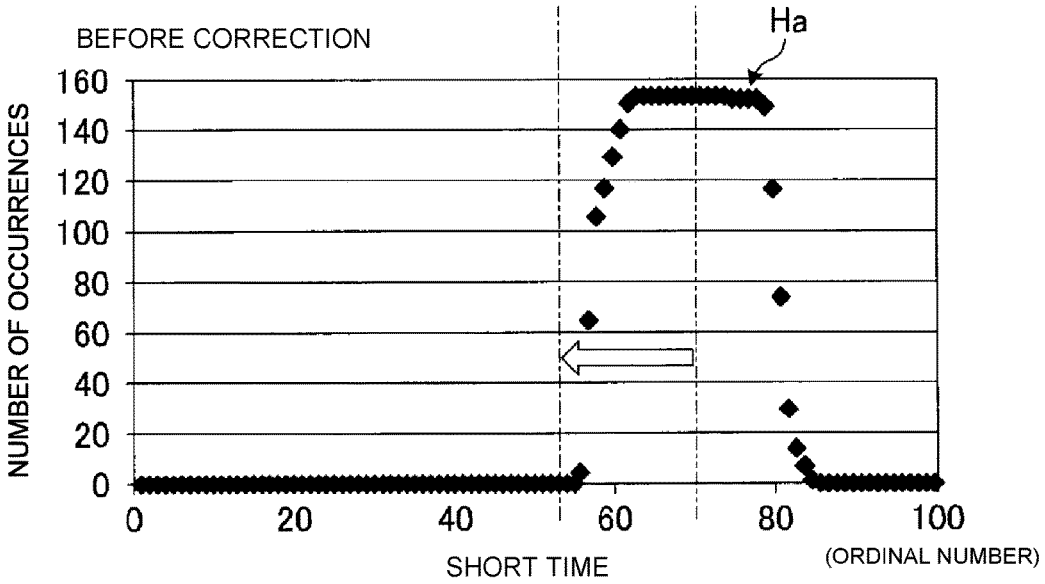
FIG. 17A is a view illustrating an example of a histogram generated by dividing the determination results included in the consecutive determination results read by the CPU of the nozzle-clogging determining device according to the embodiment and obtained by sequentially performing ejection of droplets from each nozzle, at equal intervals of time for the individual nozzles.
Figure 17B:
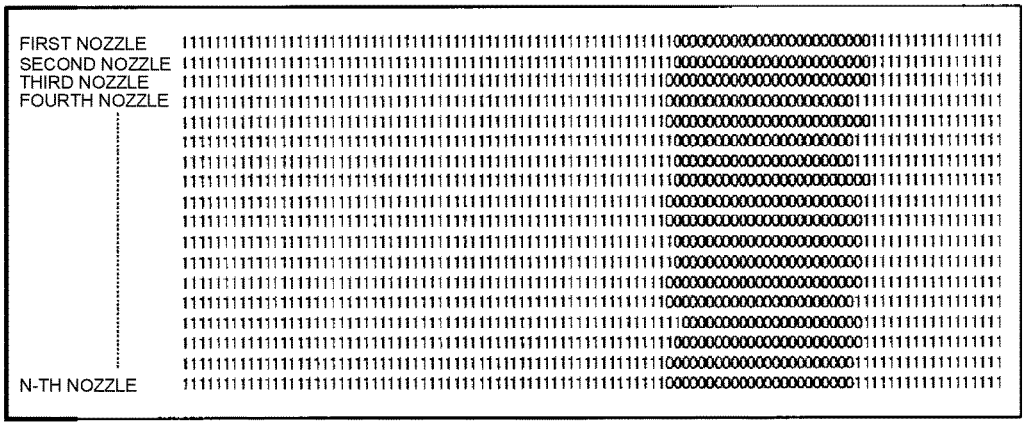
FIG. 17B is a view illustrating the determination results included in the consecutive determination results read by the CPU of the nozzle-clogging determining device according to the embodiment and obtained by sequentially performing ejection of droplets from each nozzle.
Figure 18A:
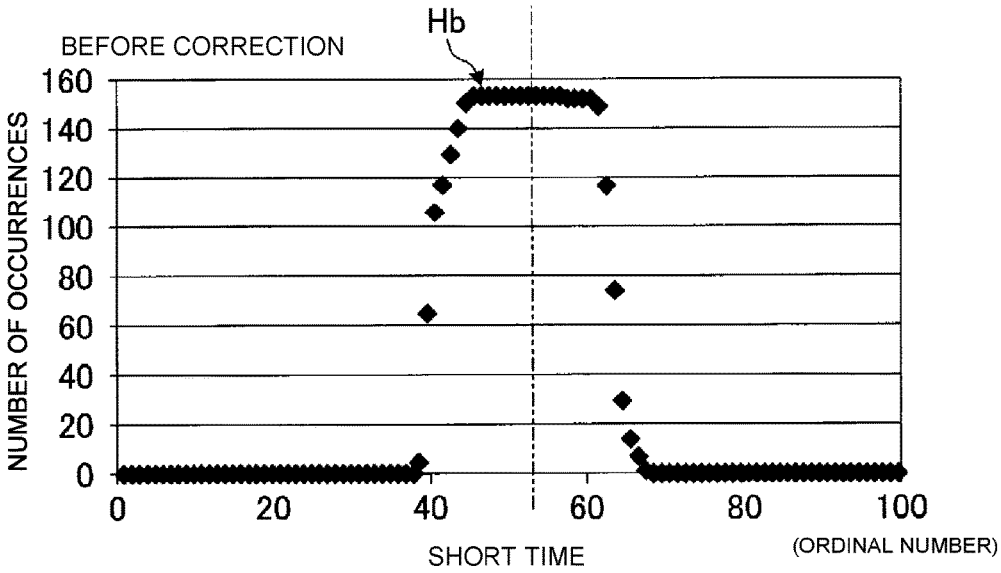
FIG. 18A is a view illustrating an example of a histogram obtained by correcting the histogram shown in FIG. 17A.
Figure 18B:
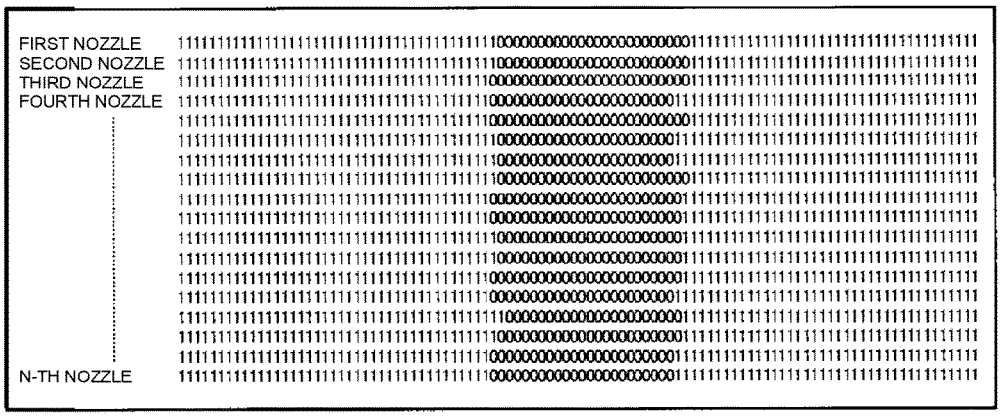
FIG. 18B is a view illustrating the determination results of the histogram of FIG. 18A obtained by sequentially performing ejection of droplets from each nozzle.

Now, a determination result analyzing method of the CPU 41, that is, the determination controller 30 will be described with reference to FIG. 11A, FIG. 11B, FIG. 15, FIG. 16, FIG. 17A, FIG. 17B, FIG. 18A, and FIG. 18B. FIG. 16 is a view illustrating an example in which determination results included in consecutive determination results read by the CPU 41 and obtained by sequentially performing ejection of droplets from each nozzle have been divided at equal intervals of time for the individual nozzles. FIG. 17A is a view illustrating an example of a histogram generated by dividing the determination results included in the consecutive determination results read by the CPU of the nozzle-clogging determining device according to the embodiment and obtained by sequentially performing ejection of droplets from each nozzle, at equal intervals of time for the individual nozzles. FIG. 17B is a view illustrating the determination results included in the consecutive determination results read by the CPU of the nozzle-clogging determining device according to the embodiment and obtained by sequentially performing ejection of droplets from each nozzle. FIG. 18A is a view illustrating an example of a histogram obtained by correcting the histogram shown in FIG. 17A. FIG. 18B is a view illustrating the determination results of the histogram of FIG. 18A obtained by sequentially performing ejection of droplets from each nozzle.

First, when the determination controller 30 analyzes the determination results, it detects a nozzle clogging determination result E (shown in FIG. 15) obtained during final ejection of consecutive droplets D from all nozzles 101, from the consecutive determination results read by the CPU 41 (STEP ST341). In the present invention, the determination controller may detect a nozzle clogging determination result obtained during first ejection of droplets D from all nozzles 101. To detect the nozzle clogging determination result E obtained during final ejection of droplets D from all nozzles 101 is because it is thought that, in the case of final ejection of droplets D, droplets D has been ejected from more nozzles 101 as compared to the case of first ejection of droplets D. The determination controller 30 divides the determination results included in the recorded consecutive determination results and obtained by sequentially performing ejection of consecutive droplets D from each nozzle 101, for the individual nozzles 101, at equal intervals of time (the predetermined period T), with reference to the nozzle clogging determination result E obtained during final ejection of droplets D from all nozzles 101 (STEP ST342).

Specifically, the determination results of the circuit 32*c* consisting of "0" or "1" are recorded at intervals of 20 μsec, and the elapsed time from start of ejection from the N-th nozzle to start of final ejection from all nozzles 101 is 12 msec. Therefore, in the consecutive determination results of the circuit 32*c*, in a period from start of the ejection from the N-th nozzle to start of final ejection from all nozzles 101, there are 600 determination results of the circuit 32*c* and 600 short time "t". Also, since the time intervals (corresponding to the predetermined period T) of ejection starts of the nozzles 101 are 2 msec, between the ejection starts of nozzles 101, there are 100 determination results of the circuit 32*c* and 100 short time "t".

The determination controller 30 divides the consecutive determination results recorded by sequentially performing ejection of consecutive droplets D from each nozzle 101, for example, from a determination result of the 541-st short time t from the last of the determination results of the circuit 32*c* of the 600 short time "t" of the period from start of ejection from the N-th nozzle to start of final ejection from all nozzles 101, toward the determination results of the first nozzle 101-1, in units of determination results of 100 short time "t". In other words, the determination controller divides the consecutive determination results obtained by sequentially performing ejection of droplets D from the individual nozzles 101, for the individual nozzles 101, such that parts determined as "0" are positioned at the center and parts determined as "1" are positioned at both end portions as shown in FIG. 17B.

Subsequently, the determination controller 30 generates a histogram representing the number of occurrences of determination results representing that nozzles are clear in the short time "t", in the determination results of the individual nozzles 101 obtained by dividing the determination results obtained by sequentially performing ejection of consecutive droplets D from each nozzle 101 for the individual nozzles 101 at equal intervals of time (the predetermined period T), and corrects the histogram such that short time "t" having the largest number of occurrences of determination results representing that nozzles are clear is positioned at the center (STEP ST343).

Specifically, the determination controller 30 calculates the number of occurrences of determination results representing that nozzles are clear, in the determination results of the circuit 32*c* divided in units of 100 short time for the individual nozzles 101 in STEP ST342, sequentially from determination results of short time "t" having an ordinal number of 1 toward determination results of short time "t" having an ordinal number of 100. For example, the determination controller arranges the determination results of the circuit 32*c* divided in units of the 100 short time "t" for the individual nozzles 101 in STEP ST342, from the first nozzle 101-1 to the N-th nozzle, as shown in FIG. 17B, and obtains the number of occurrences of determination results corresponding to short time "t" having an ordinal number of 1 and representing that nozzles are clear (the total number of determination results corresponding to short time "t" having an ordinal number of 1 and representing that nozzles are clear), in the arranged determination results, and sequentially obtains the number of occurrences of determination results corresponding to short time "t" having each ordinal number and representing that nozzles are clear (the total number of determination results corresponding to short time "t" having each ordinal number and representing that nozzles are clear), up to the ordinal number of 100.

The determination controller generates a histogram Ha having a horizontal axis representing the ordinal numbers of the short time "t" (the first short time "t" are shown at the left end in the drawing, and the hundredth short time "t" are shown at the right end in the drawing) and a vertical axis representing the total number of determination results corresponding to short time "t" having each ordinal number and representing that nozzles are clear (the number of occurrences of determination results corresponding to short time "t" having each ordinal number and representing that nozzles are clear), as shown in FIG. 17A. In other words, the vertical axis of FIG. 17A represents values obtained by arranging the determination results of the circuit 32*c* of the 100 short time "t" divided for the individual nozzles 101, in a state shown in FIG. 17B, and adding the number of short time "t" having determination results of 0, in the vertical direction of FIG. 17B.

Subsequently, the determination controller 30 obtains an ordinal number (as shown by an alternate long and two short dashes line in FIG. 17A) of short time "t" corresponding to the largest number of occurrences of determination results representing that nozzles are clear. Also, in a case where there is only one ordinal number corresponding to short time "t" corresponding to the largest number of occurrences of determination results representing that nozzles are clear, the determination controller obtains the ordinal number of the short time "t". Further, in a case where there is a plurality of ordinal numbers corresponding to short time "t" corresponding to the largest number of occurrences of determination results representing that nozzles are clear, the determination controller obtains the ordinal number of central short time "t" of those short time "t". Subsequently, the determination controller corrects a position for dividing the determination results included in the recorded consecutive determination results and obtained by sequentially performing ejection of droplets D from each nozzle 101, for the individual nozzles 101, such that the short time "t" corresponding to the largest number of occurrences and shown by the alternate long and two short dashes line in FIG. 17A is positioned at the center of the histogram Ha. Specifically, the determination controller obtains the number of short time between a short time "t" corresponding to the largest number of occurrences and shown in FIG. 17A and the center (shown by an alternate long and short dash line in FIG. 17A) of the horizontal axis of the histogram Ha in FIG. 17A, and shifts the division position of STEP ST342 by the obtained number.

For example, in the case shown in FIG. 17, when the number of short time "t" between a short time "t" having the largest number of occurrences and shown by the alternate long and two short dashes line in FIG. 17A and the center of the histogram Ha is A, the determination controller 30 divides the determination results in units of 100 short time "t" from the last of the 600 short time "t" of the period from start of ejection from the N-th nozzle to start of final ejection from all nozzles 101, for example, from the (541+A)-th short time "t", toward the determination results of the first nozzle 101-1. As a result, the determination controller 30 obtains the determination results divided for the individual nozzles 101 as shown in FIG. 16 and FIG. 18A, and a histogram Hb shown in FIG. 18A. Also, in the determination results divided for the individual nozzles 101 and shown in FIG. 16, short time "t" having determination results representing nozzles are clogged are shown by white backgrounds, and short time "t" having determination results representing nozzles are clear are shown by black backgrounds.

On the basis of the determination results divided for the individual nozzles 101 as shown in FIG. 16 and so on, the determination controller 30 determines whether the ejection states of the nozzles 101 are normal or not (STEP ST344). In the present embodiment, since eight droplets D are ejected from each nozzle 101 for 552 μsec, and "0" or "1" which is a determination result of the circuit 32*c* is recorded at intervals of 20 μsec, in a case where ink is normally ejected from the nozzles 101, at the center of the determination results divided for each nozzle 101, almost 20 short time "t" determination results of "0" are obtained.

The determination controller 30 determines that the ejection states of the individual nozzles 101 are normal, if the number of short time "t" having determination results representing that nozzles are clear, that is, "0" is equal to or greater than a predetermined number, and determines that the ejection states of the individual nozzles 101 are abnormal, if the number of short time "t" having determination results representing "0" is less than the predetermined number. In the present embodiment shown in FIG. 16, the determination controller 30 determines that the ejection states of the third nozzle 101-3 and the fourth nozzle 101-4 are normal, and determines that the ejection states of the other nozzles 101 are abnormal. Then, the determination controller 30 finishes analysis of the read determination results.

In the above-described nozzle-clogging determining device 1 according to the embodiment, since a plurality of consecutive droplets D ejected at equal intervals of time is positioned inside the spot of the detection light L which is received by the light receiver 22, it is possible to cause a difference between the intensity of the detection light which the light receiver 22 receives when droplets D block the detection light L and the intensity of the detection light which the light receiver 22 receives when any droplet D does not block the detection light L, without providing a lens usable to condense the detection light L and likely to cause an increase in the cost. Therefore, even if droplets D are small, the nozzle-clogging determining device 1 can improve the S/N ratio of the light receiver 22. Also, since the nozzle-clogging determining device 1 does not need to condense the detection light L, even if the relative positions of the head 102 having the nozzles 101 and the nozzle-clogging determining device 1 to each other shift, it is possible to position ink droplets D ejected from the head 102 inside the detection light L, and thus it is possible to surely detect nozzle clogging of ink. Therefore, the nozzle-clogging determining device 1 can detect nozzle clogging of droplets D without causing an increase in the cost.

Further, the nozzle-clogging determining device 1 has the threshold S for determining nozzle clogging when a plurality of consecutive droplets D ejected at equal intervals of time from a nozzle 101 of the head 102 is positioned inside a spot. Therefore, the nozzle-clogging determining device 1 can surely detect nozzle clogging of ink even if the relative positions of the head 102 having the nozzles 101 and the nozzle-clogging determining device 1 to each other shift, and does not need to consecutively perform ejection of a plurality of ink droplets D, a plurality of times, and can perform nozzle clogging determination on the nozzles 101 without erroneously detecting nozzle clogging. Therefore, the nozzle-clogging determining device 1 can suppress a time for detection from lengthening. Also, since the determination controller has the determination reference for determining nozzle clogging when a plurality of consecutive droplets ejected from a nozzle of the head is positioned inside a spot, the present invention can perform determination on nozzle clogging without repeating ejection of a plurality of consecutive droplets.

Also, since the nozzle-clogging determining device 1 determines nozzle clogging on the basis of the light interception rate of the detection light L which is received by the light receiver 22, it is possible to surely perform determination on nozzle clogging. Also, since the long diameter La of each spot of parallel to the traveling direction of the detection light L which is received by the light receiver 22 is longer than the short diameter Lb, the nozzle-clogging determining device 1 can position all of a plurality of consecutive droplets D ejected at equal intervals of time, inside a spot. Therefore, even if the number of droplets D is minimized, the nozzle-clogging determining device 1 can cause a difference between the intensity of the detection light L which the light receiver 22 receives when droplets D block the detection light L and the intensity of the detection light L which the light receiver 22 receives when any droplet D does not block the detection light L.

Also, the nozzle-clogging determining device 1 sequentially performs ejection of a plurality of consecutive droplets D having equal intervals of the period, at intervals of the predetermined period T, from the individual nozzles 101, and consecutively ejects droplets D from all nozzles 101 before and/or after sequentially performing consecutive ejection from the individual nozzles 101, and performs determination on nozzle clogging at intervals of the predetermined short time t, on the basis of detection results of the droplet detector 20, and consecutively records the determination results. Therefore, the nozzle-clogging determining device 1 can obtain results in which determination results obtained by ejecting ink droplets D from all nozzles 101 and determination results obtained by sequentially performing ejection of droplets D from the individual nozzles 101 are arranged in chronological order. Since the nozzle-clogging determining device 1 arranges determination results in chronological order, it is possible to quickly acquire those determination results, and it is possible to suppress determination times from lengthening. Also, since the nozzle-clogging determining device 1 uses a determination result obtained by ejecting ink droplets D from all nozzles 101 as a reference, it is possible to easily distinguish between the determination results of the nozzles 101, and it is possible to surely grasp nozzle clogging when droplets D are consecutively ejected from each nozzle 101.

Also, the nozzle-clogging determining device 1 divides the determination results obtained by sequentially performing ejection of consecutive droplets D from the individual nozzles 101, for the individual nozzles 101, at equal intervals of the period (the predetermined period T), with reference to the determination result obtained by ejecting ink droplets D from all nozzles 101. Therefore, in the nozzle-clogging determining device 1, the determination results divided at equal intervals of time include nozzle clogging determination results obtained by consecutively ejecting droplets D from the individual nozzles 101. Therefore, the nozzle-clogging determining device 1 can surely grasp nozzle clogging of droplets D from the individual nozzles 101.

Also, the nozzle-clogging determining device 1 generates a histogram, and corrects the division of the determination results obtained by sequentially performing ejection of consecutive droplets D from the individual nozzles 101, such that short time "t" corresponding to the largest number of occurrences of determination results representing that nozzles are clear is positioned at the center of the histogram. Therefore, in the nozzle-clogging determining device 1, the determination results divided at equal intervals of time surely include determination results obtained by ejecting ink from the individual nozzles 101.

Also, the nozzle-clogging determining device 1 determines whether the ejection states of the nozzles 101 are normal or not, on the basis of the number of short time "t" having determination results representing that nozzles are clear, in the determination results divided at equal intervals of time. Therefore, since the nozzle-clogging determining device 1 does not determine whether the ejection states of the nozzle 101 are normal or not, on the basis of the determination results of a small number of short time "t", it is possible to suppress erroneous determination on whether the ejection states of the nozzles 101 are normal or not.

Figure 19:
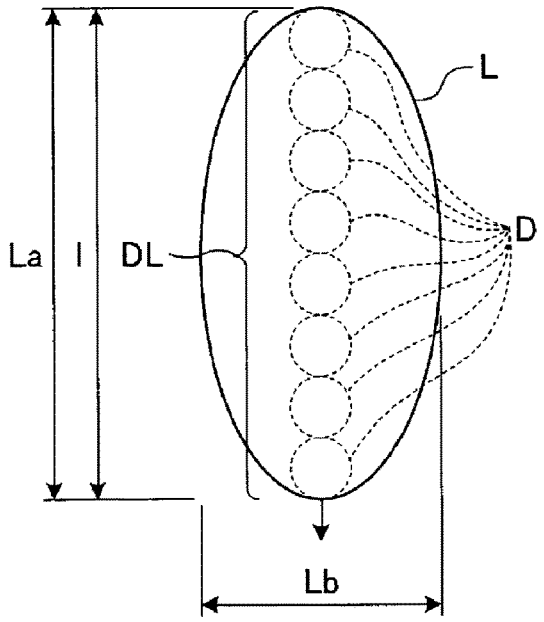
Figure 20:
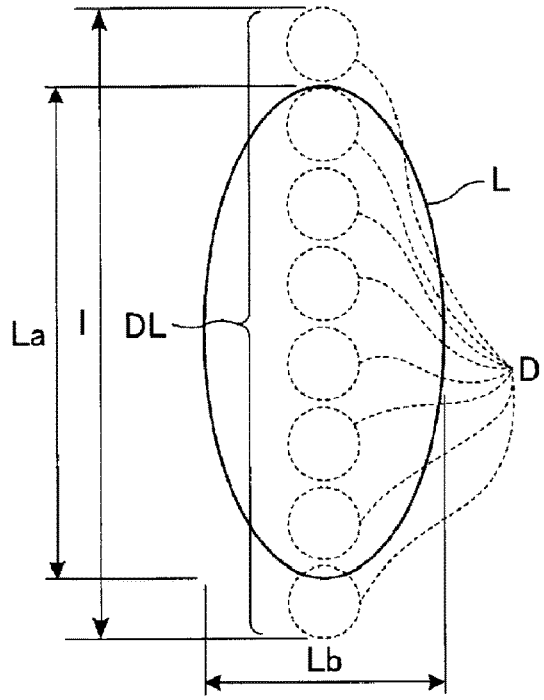

Also, in the present invention, the nozzle-clogging determining device 1 may increase an amount of ink to form droplets D such that the length l of a plurality of droplets D is almost the same as the long diameter La of each spot of the detection light L as shown in FIG. 19. The nozzle-clogging determining device 1 may increase an amount of ink to form droplets D such that the length l of a plurality of droplets D is longer than the long diameter La of each spot of the detection light L as shown in FIG. 20. FIG. 19 is a view illustrating another example of a spot of the detection light which the light receiver of the nozzle-clogging determining device according to the embodiment receives, and so on, and FIG. 20 is a view illustrating a further example of a spot of the detection light which the light receiver of the nozzle-clogging determining device according to the embodiment receives, and so on. In a case of making the length l of a plurality of droplets D almost same as the long diameter La of each spot of the detection light L or longer than the long diameter La of each spot of the detection light L as shown in FIG. 19 and FIG. 20, when a plurality of droplets D is consecutively ejected, a time required for the light interception rate of the detection light received by the light receiver 22 to be equal to or greater than the threshold S lengthens, and thus it is possible to perform accurate detection.

Also, in the present invention, it may be unnecessary to eject droplets D at equal intervals of time from the individual nozzles 101 of the head 102, and the number of determination results of each nozzle 101 based on at least the threshold S needs only to be at least one. In short, in the present invention, it is necessary only to obtain at least one determination result based on the threshold S by ejecting at least one droplet D from each nozzle 101 of the head 102.

Although the embodiments of the present invention have been described, the present invention is not limited to them. In the present invention, the embodiments can be implemented in various other forms, and various changes such as omissions, substitutions, and combinations can be made without departing from the gist of the invention.

The invention claimed is:

1. A nozzle-clogging determining device configured to detect pass of a plurality of droplets ejected from nozzles of a head of an inkjet printer, thereby performing determination on clogging of the nozzles, and the nozzle-clogging determining device comprising:

a droplet detector, including:

a light emitter, configured to emit detection light for detecting pass of the droplets in a direction intersecting with a traveling direction of the droplets; and a light receiver, configured to receive the detection light, wherein the light emitter is disposed at an end of a light path of the detection light, the light receiver is disposed at another end of the light path of the detection light, and a passage of the droplets is disposed between the light emitter and the light receiver; and a determination controller, configured to eject a plurality of droplets from the nozzles of the head, and perform determination on nozzle clogging on the basis of a light interception rate of the detection light which the light receiver receives when the droplets are positioned inside a spot of the detection light which the light receiver receives;

wherein the determination controller performs:

sequentially performing ejection of a plurality of consecutive droplets at equal intervals from individual nozzle of a plurality of nozzles formed in the head, and performing determination on nozzle clogging at intervals of a predetermined time on the basis of detection results of the droplet detector, and consecutively recording a first determination result of nozzle clogging;

recording a second determination result obtained by ejecting the droplets from the head with the first determination result of nozzle clogging in chronological order, wherein the second determination result is used as a reference for dividing the first determination result of nozzle clogging at equal intervals of time for the individual nozzles before and/or after sequentially performing consecutive ejection of the droplets from the individual nozzles; and dividing the first determination result of nozzle clogging at equal intervals of time for the individual nozzles based on the second determination result used as the reference, so as to determine whether the state of ejections of the individual nozzles are normal or not.

2. The nozzle-clogging determining device according to claim 1, wherein the determination controller determines that the nozzles are clear, in a case where the light interception rate of the detection light which the light receiver receives is equal to or greater than a predetermined light interception rate, and the determination controller determines that the nozzles are clogged, in a case where the light interception rate of the detection light is less than the predetermined light interception rate.

3. The nozzle-clogging determining device according to claim 2, wherein the determination controller performs:

sequentially performing ejection of a plurality of consecutive droplets at equal intervals from individual nozzles of the head;

before and/or after sequentially performing consecutive ejection of the droplets from the individual nozzles, consecutively ejecting droplets from all of the nozzles of the head; and performing determination on nozzle clogging at intervals of a predetermined time which is predetermined, on the basis of detection results of the droplet detector obtained by sequentially performing ejection of the droplets from the individual nozzles and ejecting droplets from all of the nozzles, and consecutively recording the first determination result of nozzle clogging, and then dividing the first determination result obtained by sequentially performing consecutive ejection of the droplets from the individual nozzles and included in the consecutively recorded determination results, for the individual nozzles, at equal intervals of time, on the basis of the second determination result obtained by ejecting droplets from all nozzles, and determining whether state of ejections of the individual nozzles are normal or not.

4. The nozzle-clogging determining device according to claim 1, wherein the light receiver is installed such that, a length of each spot of the detection light in the traveling direction of the droplets which the light emitter receives is longer than a length in a direction perpendicular to the traveling direction of the droplets, wherein the traveling direction of the droplets and the direction perpendicular to the traveling direction of the droplets are both perpendicular to the light path of the detection light.

5. The nozzle-clogging determining device according to claim 4, wherein the determination controller performs:

sequentially performing ejection of a plurality of consecutive droplets at equal intervals from individual nozzles of the head;

before and/or after sequentially performing consecutive ejection of the droplets from the individual nozzles, consecutively ejecting droplets from all of the nozzles of the head; and performing determination on nozzle clogging at intervals of a predetermined time which is predetermined, on the basis of detection results of the droplet detector obtained by sequentially performing ejection of the droplets from the individual nozzles and ejecting droplets from all of the nozzles, and consecutively recording the first determination result of nozzle clogging, and then dividing the first determination result obtained by sequentially performing consecutive ejection of the droplets from the individual nozzles and included in the consecutively recorded determination results, for the individual nozzles, at equal intervals of time, on the basis of the second determination result obtained by ejecting droplets from all nozzles, and determining whether state of ejections of the individual nozzles are normal or not.

6. The nozzle-clogging determining device according to claim 1, wherein the determination controller performs:

sequentially performing ejection of a plurality of consecutive droplets at equal intervals from individual nozzles of the head;

before and/or after sequentially performing consecutive ejection of the droplets from the individual nozzles, consecutively ejecting droplets from all of the nozzles of the head; and performing determination on nozzle clogging at intervals of a predetermined time which is predetermined, on the basis of detection results of the droplet detector obtained by sequentially performing ejection of the droplets from the individual nozzles and ejecting droplets from all of the nozzles, and consecutively recording the first determination result of nozzle clogging, and then dividing the first determination result obtained by sequentially performing consecutive ejection of the droplets from the individual nozzles and included in the consecutively recorded determination results, for the individual nozzles, at equal intervals of time, on the basis of the second determination result obtained by ejecting droplets from all nozzles, and determining whether state of ejections of the individual nozzles are normal or not.

7. The nozzle-clogging determining device according to claim 6, wherein if dividing the first determination result obtained by sequentially performing consecutive ejection of the droplets from the individual nozzles are divided for the individual nozzles, at equal intervals of time, the determination controller generates a histogram representing number of occurrences of the predetermined time having determination results representing that nozzles are clear, in the first determination result which is divided, and corrects the histogram such that the predetermined time corresponding to largest number of occurrences of determination results representing that nozzles are clear are positioned at the center.

8. The nozzle-clogging determining device according to claim 6, wherein when determining whether ejection states of the individual nozzles are normal or not, the determination controller performs:

if the number of predetermined time having determination results representing that nozzles are clear in the first determination result divided for the individual nozzles is equal to or greater than a predetermined number, determining that the ejection states are normal; and if the number of predetermined time having determination results representing that nozzles are clear in the first determination result divided for the individual nozzles is less than the predetermined number, determining that the ejection states are abnormal.

* * * * *